US008460849B2

(12) United States Patent
Ohtani et al.

(10) Patent No.: US 8,460,849 B2
(45) Date of Patent: Jun. 11, 2013

(54) HEAT-SENSITIVE TRANSFER IMAGE-RECEIVING SHEET

(75) Inventors: Shigeaki Ohtani, Minami-ashigara (JP); Takashi Shimizu, Fujinomiya (JP)

(73) Assignee: FUJIFILM Corporation, Tokyo (JP)

( * ) Notice: Subject to any disclaimer, the term of this patent is extended or adjusted under 35 U.S.C. 154(b) by 324 days.

(21) Appl. No.: 12/882,823

(22) Filed: Sep. 15, 2010

(65) Prior Publication Data

US 2011/0064895 A1 Mar. 17, 2011

(30) Foreign Application Priority Data

Sep. 16, 2009 (JP) ..... 2009-214798

(51) Int. Cl.
*G03C 8/00* (2006.01)
*B14M 5/40* (2006.01)

(52) U.S. Cl.
USPC ..... 430/200; 430/199; 430/201; 428/32.39; 428/32.6; 428/32.64; 428/32.85; 428/32.86

(58) Field of Classification Search
USPC ..... 430/200, 201, 199; 428/32.39, 32.85, 428/32.6, 32.86, 32.64
See application file for complete search history.

(56) References Cited

U.S. PATENT DOCUMENTS 5,167,987 A * 12/1992 Yu ..... 427/171
5,922,483 A * 7/1999 Takahashi et al. ..... 428/847.3
6,373,636 B1 * 4/2002 Conley ..... 359/619
6,376,165 B1 * 4/2002 Ezure et al. ..... 430/617
6,900,944 B2 * 5/2005 Tomczyk ..... 359/619
7,212,346 B2 * 5/2007 Krause ..... 359/619
7,786,039 B2 * 8/2010 Koide et al. ..... 503/227
7,858,557 B2 * 12/2010 Takehara ..... 503/227
7,863,218 B2 * 1/2011 Yoshitani et al. ..... 503/227
7,863,219 B2 * 1/2011 Arai et al. ..... 503/227
8,248,702 B2 * 8/2012 Hoffman et al. ..... 359/621
2011/0183088 A1 * 7/2011 Shimizu et al. ..... 428/32.39
2011/0200934 A1 * 8/2011 Ohtani et al. ..... 430/213

FOREIGN PATENT DOCUMENTS

JP 11-142995 A 5/1990
JP 6-282019 A 10/1994
JP 09200828 A * 7/1997
JP 3609065 B2 1/2005
JP 3789033 B2 6/2006
JP 2007190909 A * 8/2007
JP 2007230065 A * 9/2007
WO WO 2007013649 A1 * 2/2007

OTHER PUBLICATIONS

Machine translation of JP 09-300828 (no date).*

* cited by examiner

*Primary Examiner* — Amanda C. Walke
(74) *Attorney, Agent, or Firm* — Sughrue Mion, PLLC

(57) ABSTRACT

A heat-sensitive transfer image-receiving sheet, having, on a transparent support, a lenticular lens and at least one receptor layer in which the heat-sensitive transfer image-receiving sheet has a subbing layer which contains a resin that is identical with at least one resin constituting the lenticular lens, on the side of the transparent support opposite to the side on which the lenticular lens is provided, and the heat-sensitive transfer image-receiving sheet has a receptor layer containing a latex polymer on the subbing layer.

4 Claims, 1 Drawing Sheet

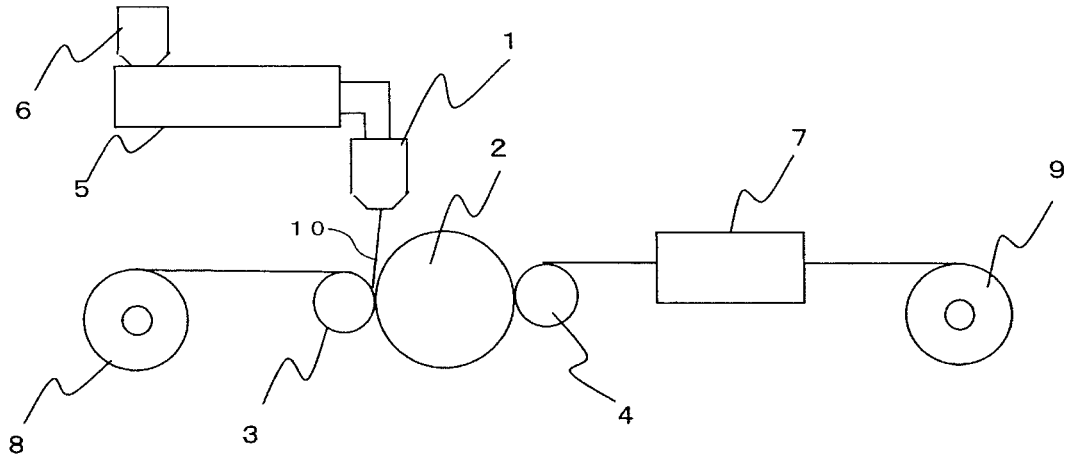
6
1
5
2
7
9
10
8
3
4

HEAT-SENSITIVE TRANSFER IMAGE-RECEIVING SHEET

FIELD OF THE INVENTION

The present invention relates to a heat-sensitive transfer image-receiving sheet having a lenticular lens, which is used in a dye diffusion transfer recording.

BACKGROUND OF THE INVENTION

In dye diffusion transfer recording systems, a heat-sensitive transfer sheet (hereinafter also referred to as an ink sheet) containing colorants (hereinafter also referred to as a dye) is superposed on a heat-sensitive transfer image-receiving sheet (hereinafter also referred to as an image-receiving sheet), and then the heat-sensitive transfer sheet is heated by a thermal head whose exothermic action is controlled by electric signals, in order to transfer the dyes contained in the heat-sensitive transfer sheet to the image-receiving sheet, thereby recording an image information. Three colors: cyan, magenta, and yellow, or four colors which consists of the three colors and black, are used for recording a color image by overlapping one color to other, thereby enabling transferring and recording a color image having continuous gradation for color densities.

On the other hand, in recent years, the demands on color images are diversified, and there is a demand for obtaining three-dimensional images conveniently and inexpensively. It has been known that, so as to make a picture, a photograph or the like to appear stereoscopic, a lenticular lens (sheet-shaped, hereinafter also referred to as a lenticular lens sheet) formed from semi-cylindrical lenses is attached on a printed picture or photograph correspondingly to the right-side eye and the left-side eye. In order to make the picture, photograph, or the like appear stereoscopic with high precision in this technique, it is required that the printed images viewed respectively by the right-side eye and the left-side eye are disposed in correspondence with the positions of the respective lenses of the lenticular lens.

Japanese Patent No. 3609065 discloses an image recording apparatus equipped with a recording unit that records an image on the back side of the lenticular lens sheet; a moving mechanism for moving the recording unit and the lenticular lens sheet relatively to each other; a position detecting unit provided to be contacted with the concave parts and/or convex parts of the lenticular lens sheet; and a recording control unit that controls the recording unit to perform recording while detecting the position of the lenticular lens sheet by means of the position detecting unit.

Japanese Patent No. 3789033 discloses a method for producing a lenticular lens sheet printed material, including: preparing a heat transfer sheet provided with a coloring material transfer unit and a white layer transfer unit in area order on the same surface of a substrate film; thermally moving the coloring material from the coloring material transfer unit to the back surface of the lenticular lens sheet by using a heating device; and subsequently thermally transferring the white layer on the lenticular lens sheet.

JP-A-6-282019 ("JP-A" means unexamined published Japanese patent application) discloses a heat-sensitive transfer recording sheet for stereoscopic photographs, which utilizes a lenticular lens sheet as a substrate and has a dye receptor layer provided on the back side of the lenticular lens sheet.

However, when images are printed using such the lenticular lens sheet and the heat-sensitive transfer image-recording sheet, a transfer failure in the form of white or colored spots occurs in black and high-density image areas. There was posed a new problem that when identical images are printed, the three-dimensional sensation of the images viewed through the lenticular lens may be lowered. These problems are prone to occur under high temperature and high humidity conditions or under low temperature and low humidity conditions, and thus it is strongly demanded to solve these problems.

SUMMARY OF THE INVENTION

The present invention resides in a heat-sensitive transfer image-receiving sheet, having on a transparent support:

a lenticular lens; and at least one receptor layer, wherein the heat-sensitive transfer image-receiving sheet has a subbing layer which contains a resin that is identical with at least one resin constituting the lenticular lens, on the side of the transparent support opposite to the side on which the lenticular lens is provided, and wherein the heat-sensitive transfer image-receiving sheet has a receptor layer containing a latex polymer on the subbing layer.

Other and further features and advantages of the invention will appear more fully from the following description, appropriately referring to the accompanying drawings.

BRIEF DESCRIPTION OF THE DRAWINGS

FIG. 1 is an overall process flow diagram showing an example of method for producing a subbing layer and a lenticular lens sheet resin layer.

DETAILED DESCRIPTION OF THE INVENTION

According to the present invention, there is provided the following means:

(1) A heat-sensitive transfer image-receiving sheet, having on a transparent support:

a lenticular lens; and at least one receptor layer, wherein the heat-sensitive transfer image-receiving sheet has a subbing layer which contains a resin that is identical with at least one resin constituting the lenticular lens, on the side of the transparent support opposite to the side on which the lenticular lens is provided, and wherein the heat-sensitive transfer image-receiving sheet has a receptor layer containing a latex polymer on the subbing layer.

(2) The heat-sensitive transfer image-receiving sheet as described in the above item (1), wherein said at least one resin that constitutes the lenticular lens and identical to at least one resin that constitutes the subbing layer is a polymethyl methacrylate resin, a polycarbonate resin, a polystyrene resin, a methacrylate-styrene copolymer resin, a polyethylene resin, a polyethylene terephthalate resin, or a glycol-modified polyethylene terephthalate resin.

(3) The heat-sensitive transfer image-receiving sheet as described in the above item (1) or (2), wherein at least one of the latex polymers is a copolymer containing a vinyl chloride component as a constituent component.

(4) The heat-sensitive transfer image-receiving sheet as described in any one of items (1) to (3), wherein the receptor layer contains, together with the latex polymer; at least one polyether-modified silicone represented by formula (S1):

Formula (S1)

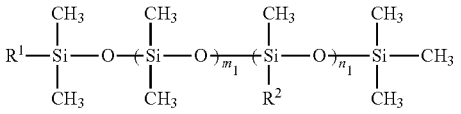

wherein $R^1$ represents an alkyl group; $R^2$ represents —X—$(C_2H_4O)_{a1}$—$(C_3H_6O)_{b1}$—$R^3$; $R^3$ represents a hydrogen atom, an acyl group, an alkyl group, a cycloalkyl group or an aryl group; X represents an alkylene group or an alkyleneoxy group; $m_1$ and $n_1$ each independently represents a positive integer; $a_1$ represents a positive integer; and $b_1$ represents 0 or a positive integer.

Hereinafter, the present invention will be described in detail. In the present specification, "to" denotes a range including numerical values described before and after it as a minimum value and a maximum value.

The heat-sensitive transfer image-receiving sheet of the present invention is described below.

<Heat-Sensitive Transfer Image-Receiving Sheet>

The heat-sensitive transfer image-receiving sheet of the present invention has a lenticular lens and at least one receptor layer on a transparent support, and has a subbing layer formed from a resin that is identical with a resin constituting the lenticular lens, on the side of the transparent support that is opposite to the lenticular lens.

[Support]

The support of the image-receiving sheet of the present invention is a transparent support, and it is preferable that the transparent support has a sheet surface that is as smooth as possible. Further, the support is required to endure the heat of a melt and extruded resin sheet, and a polycarbonate resin, a polysulfone resin, a polyimide resin, a biaxially stretched polyethylene terephthalate resin and the like, which have relatively high heat resistance, may be used for the support. Particularly, a biaxially stretched polyethylene terephthalate resin is preferred in view of well smoothness.

Furthermore, in order to adhere the subbing layer or the resin for forming the lenticular lens more firmly onto the transparent support, it is preferable to provide an adhesive resin on the transparent support. Examples of this adhesive resin include a modified polyolefin-series resin, a polyester-series thermoplastic elastomer, and the like. This adhesive resin may be disposed on one side or on both sides of a transparent thermoplastic resin for forming the transparent support, and the resins may be co-extruded with the transparent support.

[Subbing Layer]

The subbing layer is provided on the side of the transparent support that is opposite to the side where the lenticular lens of the transparent support is provided. In the present invention, at least one resin that constitutes the subbing layer is identical with at least one resin that constitutes the lenticular lens. If the resin constituting the subbing layer and the resin constituting the lenticular lens respectively include multiple resins, it is preferable that all of the multiple resins are identical with each other.

Examples of the resin that constitutes the subbing layer include a polymethyl methacrylate resin (PMMA), a polycarbonate resin, a polystyrene resin, a methacrylate-styrene copolymer resin (MS resin), an acrylonitrile-styrene copolymer resin (AS resin), a polypropylene resin, a polyethylene resin, a polyethylene terephthalate resin, a glycol-modified polyethylene terephthalate resin, a polyvinyl chloride resin (PVC), a thermoplastic elastomer, or copolymers thereof, a cycloolefin polymer, and the like. Upon considering the ease of melt and extrusion, it is preferable to use a resin having a low melt viscosity, for example, a polymethyl methacrylate resin (PMMA), a polycarbonate resin, a polystyrene resin, a methacrylate-styrene copolymer resin (MS resin), a polyethylene resin, a polyethylene terephthalate resin, or a glycol-modified polyethylene terephthalate resin. On the other hand, upon considering the ease of transfer, difficulty of cracking in the sheet, durability of a pattern and the like, it is more preferable to use a glycol-modified polyethylene terephthalate resin.

(Formation of Subbing Layer)

Formation of the subbing layer on the transparent support is carried out by a step of changing an embossed roller 2 shown in FIG. 1 to a mirror-surface roller. A method of continuously forming a subbing layer by inserting a moving transparent support 8 between the mirror-surface roller 2 and a nip roller 3, extruding a transparent thermoplastic resin 10 from a sheet die 1, to be supplied and laminated thereby between the transparent support 8 and the mirror-surface roller 2, and solidifying the transparent thermoplastic resin 10 by cooling while winding the resin around the mirror-surface roller 2, is preferably used.

Subsequently to the formation of the subbing layer, it is also preferable to provide by coating a receptor layer as described below by using a coating and drying step 7.

[Lenticular Lens]

The resin that constitutes the lenticular lens is preferably identical with the resin that constitutes the subbing layer, and the preferred examples are also the same as the preferred examples for the subbing layer.

(Formation of Lenticular Lens)

The method for producing a lenticular lens pattern includes providing a lenticular lens forming resin layer on a sheet 8 (a substrate sheet 8) prepared by forming the subbing layer on the transparent support, or on a sheet prepared by coating a receptor layer that will be described below after the formation of the subbing layer, and forming a fine pattern on the surface of this lenticular lens forming resin layer. The lenticular lens pattern can be preferably produced by a method of continuously transferring a pattern shape onto the surface of a moving sheet, in which the sheet 8 prior to having the lenticular lens resin layer provided thereon is inserted between the embossed roller 2 having the desired pattern shape bonded thereon and the nip roller 3, a transparent thermoplastic resin for forming the lenticular lens (a resin sheet 10) and an adhesive resin are co-extruded from the sheet die 1, to be supplied thereby between the embossed roller 2 and the sheet 8 prior to having the lenticular lens resin layer provided thereon, the resins are laminated by being pressed with the nip roller 3, and the laminate is solidified by cooling while being wound around the embossed roller 2.

The pattern shape of the lenticular lens resin layer in the present invention may be a conventional pattern shape and is not particularly limited. However, a preferred shape is such that the lens pitch is 100 to 318 μm, the radius is 100 to 200 μm, and the thickness of the lens sheet is 200 to 400 μm.

Hereinafter, a preferred method for producing the lenticular lens sheet as described above will be explained in detail.

The lenticular lens sheet as used herein means a sheet having a subbing layer, a receptor layer and a lenticular lens resin layer formed thereon, and a pattern sheet means a sheet having a concavo-convex pattern of the lenticular lens formed thereon.

FIG. 1 is an overall process diagram showing an example of the method for producing a subbing layer and a lenticular lens sheet resin layer.

As shown in FIG. 1, the method for producing the subbing layer and the lenticular lens sheet resin layer mainly includes a raw material step of performing metering and mixing of the raw materials; an extrusion step of continuously extruding a molten resin into a sheet form (band form); a transport step of conveying the sheet prior to having the lenticular lens resin layer provided thereon, which is wound as roll shape; a cooling and transfer step of feeding the extruded resin sheet between the embossed roller and the sheet prior to having the lenticular lens resin layer provided thereon, solidifying by cooling the sheets while laminating the sheets by pressing with a rubber roller, to transfer thereby the pattern shape; a peeling step of peeling the laminated and solidified resin sheet from the embossed roller; and a rolling step of rolling up the obtained sheet into a roll form. In order to install the subbing layer, the embossed roller 2 is changed to a mirror-surface roller before use.

Furthermore, after installing the subbing layer, a coating and drying step is provided during the production process in order to install a receptor layer by coating.

In the raw material step, a raw material resin sent from a raw material silo (or a raw material tank) to a vacuum dryer is dried until a predetermined moisture content is reached.

In the extrusion step, the dried raw material resin is fed into an extruder 5 via a hopper 6, and is melted while being kneaded by this extruder 5. The extruder 5 may be any of a single-screw extruder or a multi-screw extruder, and may also have a vent function for creating a vacuum inside the extruder 5. The raw material resin melted by the extruder 5 is sent to the die 1 (for example, a T-die) via a supply duct. At this time, plural extruders may be used to merge at the feed block and form a multilayer. In order to enhance the adhesiveness to the lenticular lens resin layer, an adhesive resin may be disposed between the lenticular lens resin layer and the transparent support. The resin sheet extruded into a sheet form from the die 1 is then sent to the cooling and transfer step.

Here, the sheet 8 prior to having the lenticular lens resin layer provided thereon is conveyed from the transport step and enters the cooling and transfer step between the embossed roller 2 and the nip roller 3. In the cooling and transfer step, the resin sheet 10 extruded from the die is supplied between the embossed roller 2 and the sheet 8 prior to having the lenticular lens resin layer, and is solidified by cooling while being laminated by pressing with the nip roller 3, and thereby the pattern shape is transferred. The solidified pattern sheet is peeled by a peeling roller 4.

On the surface of the embossed roller 2, for example, a reverse shape for molding the lenticular lens sheet is formed. Regarding the material of the embossed roller, various steel members, stainless steel, copper, zinc, brass; products produced by using these metallic materials as core metals and subjecting the materials to plating such as hard chrome plating (HCr plating), Cu plating or Ni plating; ceramics, and various composite materials can be employed.

The nip roller 3 is a roller which is disposed opposite to the embossed roller 2 and is intended to compress the substrate sheet 8 and the resin sheet together with the embossed roller 2. Regarding the material for the nip roller 3, various steel members, stainless steel, copper, zinc, brass, and products produced by using these metallic materials as core metals and providing a rubber lining on the surface thereof, can be employed.

The nip roller 3 is provided with pressing units that are not depicted in the diagram, such that the pressing units can compress the substrate sheet 8 and the resin sheet 10 between the nip roller 3 and the embossed roller 2 with a predetermined pressure. These pressing units are all constructed to apply pressure in the normal line direction at the contact point between the nip roller 3 and the embossed roller 2, and various known units such as a motor-driven unit, an air cylinder and a hydraulic cylinder can be employed.

For the nip roller 3, a construction which is not likely to generate deflection due to the reaction force of the compressing force, can be employed. Examples of such construction that can be employed include a construction of providing a back-up roller which is not depicted in the diagram, on the rear side of the nip roller 3 (opposite side of the embossed roller), a construction of employing a crown shape (a shape having a peak in the middle), a construction of using a roller having a strength distribution such that the hardness at the central part in the direction of the axis of the roller is larger than that of other parts, constructions combining these, and the like.

The peeling roller 4 is a roller which is disposed opposite to the embossed roller 2 and is intended to peel off the sheet on which the concavo-convex pattern of the lenticular lens has been formed, from the embossed roller 2 by winding the patterned sheet around the peeling roller. Regarding the material of the peeling roller, various steel members, stainless steel, copper, zinc, brass, and products produced by using these metallic materials as metal cores and providing a rubber lining on the surface thereof, can be employed.

The temperature of the embossed roller 2 is preferably set such that the temperature of the resin sheet at the compressed part is at or above the glass transition temperature, so that the resin sheet is not cooled and solidified before the transfer to the compressed resin sheet is completed. On the other hand, if the adhesion between the embossed roller and the sheet on which the concavo-convex pattern of the lenticular lens has been formed is too strong in the peeling step using the peeling roller, the patterned sheet peels off irregularly and is deformed into a protruded shape. Therefore, it is preferable to set the temperature of the embossed roller at the lowest possible temperature to achieve transfer. In the case of employing a glycol-modified polyethylene terephthalate resin as the resin material, the surface temperature of the embossed roller can be set at 30 to 90° C., and preferably 40 to 70° C. In order to control the temperature of the embossed roller, a known method such as filling the inside of the embossed roller with a thermal medium (warm water, oil) and circulating the thermal medium, can be employed.

The ejection temperature of the molten resin from the die 1 is preferably set up such that the temperature of the resin sheet at the compressed part is at or above the glass transition temperature, so that the resin sheet is not cooled and solidified before the transfer to the compressed resin sheet is completed. On the other hand, if the adhesion between the embossed roller 2 and the sheet on which the concavo-convex pattern of the lenticular lens has been formed is too strong in the peeling step using the peeling roller 4, the patterned sheet peels off irregularly and is deformed into a protruded shape. Furthermore, since there occur problems such as deterioration of the surface state due to thermal decomposition of the resin, it is preferable to set the ejection temperature at the lowest possible temperature to achieve transfer. In the case of employing a glycol-modified polyethylene terephthalate resin as the resin material, the ejection temperature from the die can be set at 240 to 290° C., and preferably at 250 to 280° C.

[Receptor Layer]

The heat-sensitive transfer image-receiving sheet of the present invention has at least one receptor layer on the subbing layer.

The receptor layer plays a role of being dyed with a dye migrated from the heat-sensitive transfer sheet and maintaining a formed image. In the present invention, the receptor layer contains at least a latex polymer. It is preferable for the present invention that the heat-sensitive transfer image-receiving sheet have two or more (preferably two) receptor layers. According to a preferred embodiment, an undercoat layer may be provided between the subbing layer and the receptor layer so as to impart various functions such as, for example, white background adjustment, charge prevention, adhesiveness, cushion properties and smoothness.

(Latex Polymer)

In the present specification, the latex polymer is a dispersion in which water-insoluble hydrophobic polymers are dispersed as fine particles in a water-soluble dispersion medium. The dispersed state may be one in which spherical polymer-polymerized particles and/or a polymer are/is emulsified in a dispersion medium, one in which spherical polymer-polymerized particles and/or a polymer are/is undergone emulsion polymerization, one in which spherical polymer-polymerized particles and/or a polymer are/is undergone micelle dispersion, one in which polymer molecules partially have a hydrophilic structure and thus the molecular chains themselves are dispersed in a molecular state, or the like. Among them, spherical polymer-polymerized particles are particularly preferable.

The receptor layer may also use, other than the latex polymer as a receptor polymer which receives the dye migrated from the heat-sensitive transfer sheet and thereby forms a recorded image at the time of heat-sensitive transfer, a latex polymer having the other functions in combination for the purpose of, for example, regulating the elastic modulus of a film.

The average particle diameter of the dispersed particles of the latex polymer used in the receptor layer is preferably 1 to 1,000 nm, particularly preferably 5 to 500 nm.

Examples of the thermoplastic resins used for the latex polymer used in the receptor layer of the present invention include polycarbonates, polyesters, polyacrylates, vinyl chloride, vinyl chloride copolymers, polyurethane, styrene/acrylonitrile copolymers, polycaprolactone and the like.

Among them, polyesters, polyacrylate, vinyl chloride, and vinyl chloride copolymers are preferable; polyesters, vinyl chloride and vinyl chloride copolymers are particularly preferable; vinyl chloride, vinyl chloride copolymers are further preferable; and vinyl chloride copolymers are most preferable.

In the present specification, the vinyl chloride copolymer is a copolymer containing a vinyl chloride component as a constituent component, and a copolymer prepared with vinyl chloride as a polymerization monomer and other monomers, and examples thereof include vinyl chloride-vinyl acetate copolymers, vinyl chloride-acrylate copolymers, vinyl chloride-methacrylate copolymers, vinyl chloride-vinyl acetate-acrylate copolymers, and vinyl chloride-acrylate-ethylene copolymers. As described above, the copolymer may be a binary copolymer or a ternary or higher copolymer, and the monomers may be distributed randomly or uniformly by block copolymerization.

These copolymers may contain an auxiliary monomer component such as vinylalcohol derivatives, maleic acid derivatives, and vinyl ether derivatives.

The vinyl chloride copolymer used in the present invention preferably contains the vinyl chloride component as a main component "containing the vinyl chloride component as a main component" means containing the vinyl chloride component in an amount of 50 mol % or more. The vinyl chloride component is preferably contained in an amount of 50 mol % or more, and the auxiliary monomer component such as maleic acid derivative and vinyl ether derivative is preferably contained in an amount of 10 mol % or less.

In the present invention, the latex polymers used in the receptor layer may be used alone or as a mixture. The latex polymer used in the receptor layer may have a uniform structure or a core/shell structure, and in the latter case, the resins constituting the core and shell respectively may have different glass transition temperatures.

In the present invention, the glass transition temperature (Tg) of the latex polymer that is used in the receptor layer is preferably −30° C. to 100° C., more preferably 0° C. to 90° C., further preferably 20° C. to 90° C., and further more preferably 40° C. to 90° C.

The glass transition temperature (Tg), if not practically measurable, may be calculated according to the following formula:

$$1/Tg=\Sigma(Xi/Tgi)$$

wherein, assuming that the polymer is a copolymer composed of n monomers from i=1 to i=n; Xi is a mass fraction of the i-th monomer ($\Sigma Xi=1$); Tgi is a glass transition temperature (measured in absolute temperature) of a homopolymer formed from the i-th monomer; and the symbol $\Sigma$ means the sum of i=1 to i=n. The value of the glass transition temperature of a homopolymer formed from each monomer (Tgi) can be adopted from J. Brandrup and E. H. Immergut, "Polymer Handbook, 3rd. Edition", Wiley-Interscience (1989).

The polymer concentration in the latex polymer preferably used in the present invention is preferably 10 to 70 mass %, more preferably 20 to 60 mass % with respect to the latex liquid. The addition amount of the latex polymer (latex polymer solid content) is preferably 50 to 98 mass %, more preferably 70 to 95 mass %, with respect to all polymers in the receptor layer.

Preferable examples of the latex polymer that can be used in the present invention may preferably include latex polymers such as acrylic-series polymers; polyesters; rubbers (e.g., SBR resins); polyurethanes; polyvinyl chloride copolymers including copolymers such as vinyl chloride/vinyl acetate copolymer, vinyl chloride/acrylate copolymer, and vinyl chloride/methacrylate copolymer; polyvinyl acetate copolymers including copolymers such as ethylene/vinyl acetate copolymer; and polyolefins. These latex polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight.

The latex polymer used in the present invention is preferably exemplified by any one of polyester latexes; vinyl chloride latex copolymers such as vinyl chloride/acrylic compound latex copolymer, vinyl chloride/vinyl acetate latex copolymer, and vinyl chloride/vinyl acetate/acrylic compound latex copolymer, or arbitrary combinations thereof.

Examples of the vinyl chloride latex copolymer include VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 685, VINYBLAN 867, VINYBLAN 900, VINYBLAN 938 and VINYBLAN 950 (trade names, manufactured by Nissin Chemical Industry Co., Ltd.); and SE1320, S-830 (trade names, manufactured by Sumica Chemtex). These are preferable latex polymers in the present invention.

A latex polymer other than the vinyl chloride latex copolymer may include a polyester-series latex polymer. The polyester-series latex polymer is preferably exemplified by VIRONAL MD1200, VIRONAL MD1220, VIRONAL MD1245, VIRONAL MD1250, VIRONAL MD1500, VIRONAL MD1930, and VIRONAL MD1985 (trade names, manufactured by Toyobo Co., Ltd.).

Among these, vinyl chloride-series latex copolymers such as a vinyl chloride/acrylic compound latex copolymer (particularly, a vinyl chloride/acrylic ester latex copolymer), a vinyl chloride/vinyl acetate latex copolymer, a vinyl chloride/vinyl acetate/acrylic compound latex copolymer (particularly, a vinyl chloride/vinyl acetate/acrylic ester latex copolymer), are more preferable, a vinyl chloride/acrylic compound latex copolymer is most preferable. In the present invention, it is also preferable to use the latexes in combination of two or more kinds thereof.

If the heat-sensitive transfer image-receiving sheet has two receptor layers, it is preferable that all of these receptor layers contain the respective latexes of vinyl chloride and a vinyl chloride-series copolymer, and it is also preferable that the resin contained in the upper receptor layer have a higher glass transition temperature (Tg) than that of the resin contained in the lower receptor layer (receptor layer on the support side).

(Water-Soluble Polymer)

In the present invention, the receptor layer may contain a water-soluble polymer, and a gelatin, a polyvinyl alcohol, a polyvinylpyrrolidone, and a polyvinylpyrrolidone copolymer are preferably used. Among them, a gelatin is preferably used, for the reason that the gelatin has good settability at the time of coating. These water-soluble polymers are effective in controlling hydrophilicity and hydrophobicity of the receptor layer, and if the water-soluble polymer is used in a non-excessive amount, dye transfer from the ink sheet is well, and also, a good transfer density is obtained.

The amount of use of the water-soluble polymer is preferably 0.1 to 10% by mass, and more preferably 0.5 to 5% by mass, relative to the total mass of the solid content in the receptor layer.

(Polyether-Modified Silicone)

In the present invention, it is preferable that the receptor layer contains silicone, and it is preferable that the receptor layer contains a polyether-modified silicone. As the polyether-modified silicone, it is particularly preferable that the receptor layer contains a polyether-modified silicone represented by the following formula (S1).

Formula (S1)

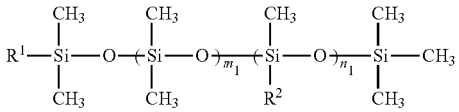

In formula (S1), $R^1$ represents an alkyl group; $R^2$ represents $—X—(C_2H_4O)_{a1}—(C_3H_6)_{b1}—R^3$; $R^3$ represents a hydrogen atom, an acyl group, a monovalent alkyl group, a monovalent cycloalkyl group, and a monovalent aryl group; X represents an alkylene group or an alkyleneoxy group; $m_1$ and $n_1$ each independently represent a positive integer; $a_1$ represents a positive integer; and $b_1$ represents 0 or a positive integer.

The alkyl group represented by $R^1$ may represent a branched alkyl group. The alkyl group represented by $R^1$ is preferably an alkyl group having 1 to 20 carbon atoms, more preferably 1 to 8 carbon atoms, still more preferably 1 to 4 carbon atoms. Among them, a methyl group and an ethyl group are preferable and a methyl group is most preferable.

The acyl group having an acyl moiety represented by $R^3$ includes, for example, an acetyl group, a propionyl group, a buthylyl group, and a benzoyl group. Among these acyl groups, an acyl group having 2 to 20 carbon atoms is preferable and an acyl group having 2 to 10 carbon atoms is more preferable.

The monovalent alkyl group represented by $R^3$ includes, for example, a methyl group, an ethyl group, a propyl group, an isopropyl group, a buthyl group, and a tert-buthyl group. The monovalent alkyl group is preferably a monovalent alkyl group having 1 to 20 carbon atoms, more preferably 1 to 10.

The monovalent cycloalkyl group represented by $R^3$ includes, for example, a cyclopenthyl group and a cyclohexyl group. The monovalent cycloalkyl group is preferably a monovalent cycloalkyl group having 5 to 10 carbon atoms.

The monovalent aryl group represented by $R^3$ includes, for example, a phenyl group and a naphthyl group. An aryl moiety of the monovalent aryl group is preferably a benzene ring.

$R^3$ preferably represents a monovalent alkyl group, preferably a methyl group and a butyl group, particularly preferably a methyl group.

The linking group represented by X is preferably an alkylene group and an alkyleneoxy group. The alkylene group preferably includes, for example, a methylene group, an ethylene group, and a propylene group. The alkyleneoxy group preferably includes, for example, $—CH_2CH_2O—$, $—CH(CH_3)CH_2O—$, $—CH_2CH(CH_3)O—$, and $—(CH_2)_3O—$. The divalent linking group X preferably has 1 to 4 carbon atoms and more preferably 2 or 3.

In addition, X more preferably represents an alkylene group and particularly preferably a propyleneoxy group ($—(CH_2)_3O—$).

The above $a_1$ is preferably an integer of 1 or larger, more preferably 1 to 200, and even more preferably 1 to 100. The above $b_1$ is preferably 0 or an integer of 1 or larger, more preferably 0 to 200, and even more preferably 0 to 100. Further, in order to exert more effectively the action of preventing separation lines in high-density image areas, by the present invention, it is more preferable that among the values of $a_1$ and $b_1$, $a_1$ is preferably 30 or larger, more preferably 35 or larger, particularly preferably 40 or larger. Herein, the preferably upper limit of $a_1$ is 100 or less. Both of $a_1$ and $b_1$ are 30 or larger, more preferably 35 or larger, particularly preferably 40 or larger. Herein, the preferably upper limit each of $a_1$ and $b_1$ is 100 or less.

In order to more effectively exhibit the action of preventing separation lines in high-density image areas, by the present invention, $m_1$ is preferably 10 to 500, more preferably 30 to 300, and most preferably 50 to 200.

The above $n_1$ is preferably 1 to 50, and more preferably 1 to 20.

The polyether-modified silicone preferably has an average molecular weight of 55,000 or less, and more preferably 40,000 or less. The average molecular weight in the present invention represents a mass average molecular weight. The mass average molecular weight used herein is a molecular weight value obtained by measuring a molecular weight with a GPC analyzer using columns of TSKgel GMHxL, TSKgel G4000HxL and TSKgel G2000HxL (trade names, manufactured by Tosoh Corporation) and then converting the measured value using polystyrene as a reference material; the solvent used for GPC is THF and the detection is conducted by a differential refractometer.

It is preferable that the polyether-modified silicone is a liquid at 25° C.

The polyether-modified silicone is also such that the viscosity thereof is preferably from 500 mPa·s to 10,000 mPa·s, more preferably from 1000 mPa·s to 5000 mPa·s, and even more preferably from 2000 mPa·s to 5000 mPa·s. The methods for viscosity measurement may be roughly classified into methods of measuring the resistance force exerted to a rotating body in the liquid, and methods of measuring the pressure loss occurring when the liquid is passed through an orifice or a capillary. The former methods involve rotary type viscometers, which are represented by a B type viscometer. The latter methods involve capillary viscometers, which are represented by an Ostwald viscometer. In the present invention, the viscosity is defined as a value measured with a B type viscometer at a temperature of 25° C.

The HLB (Hydrophile-Lipophile-Balance) value of the polyether-modified silicone represented by formula (S1) is preferably 4.0 to 8.0, and particularly preferably 4.5 to 6.5. If the HLB value is too low, failure in the surface state is likely to occur. If the HLB value is too high, the ability of preventing the generation of separation lines is decreased.

In the present invention, the HLB value is determined by a calculation formula defined by the following expression based on the Griffin's method ("Kaimennkasseizaibinnrann (Handbook of Surfactant)," co-authored by Ichiro Nishi, Tooziro Imai and Masai Kasai, published by Sangyo Tosho Co., Ltd., 1960).

$$HLB=20\times Mw/M$$

Here, M represents the molecular weight, and Mw represents the formula weight (molecular weight) of the hydrophilic moiety. In addition, M=Mw+Mo, wherein Mo is the formula weight (molecular weight) of the lipophilic moiety. The hydrophilic moiety in this case is an ethyleneoxy group.

Examples of the polyether-modified silicone oil that is preferably used in the present invention include KF-351A, KF-352A, KF-353, KF-354L, KF-355A, KF-615A, KF-945, KF-640, KF-642, KF-643, KF-6020, KF-6011, KF-6012, KF-6015, KF-6017, X-22-4515 and X-22-6191 (trade names, manufactured by Shin-Etsu Chemical Co., Ltd.); and SH3749, SH3773M, SH8400, SF8427, SF8428, FZ-2101, FZ-2104, FZ-2110, FZ-2118, FZ-2162, FZ-2203, FZ-2207, FZ-2208, FZ-77, L-7001 and L-7002 (trade names, manufactured by Dow Corning Toray Co., Ltd.).

The polyether-modified silicone oil preferably used in the present invention can be easily synthesized by the methods described in, for example, JP-A-2002-179797, JP-A-2008-1896, and JP-A-2008-1897, or methods equivalent to these methods.

In the present invention, the polyether-modified silicone oil can be used singly, or in combination of two or more kinds thereof can also be used. Also, in the present invention, the other releasing agent may be used in combination with the polyether-modified silicone oil.

The addition amount of the polyether-modified silicone oil is preferably 1% by mass to 20% by mass (solid content %), and more preferably 1% by mass to 10% by mass (solid content %), based on the total amount of the latex polymer in the receptor layer.

The coating amount of the receptor layer in the present invention is preferably 0.5 to 10.0 g/m$^2$, and more preferably 1.0 to 8.0 g/m$^2$. The term "coating amount" in the present specification is a value calculated in terms of the solid contents, unless particularly stated otherwise.

(Surfactant)

In the present invention, it is preferable that the receptor layer contains a surfactant. The surfactant is preferably an anionic surfactant or a nonionic surfactant, and is more preferably an anionic surfactant.

Among the anionic surfactants, it is more preferable that the receptor layer contains at least one anionic surfactant represented by the following formula (A1) or (A2). In order to greatly exhibit the effects of the present invention, a compound represented by the following formula (A1) is particularly preferable.

Formula (A1)

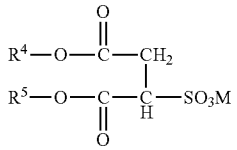

In formula (A1), $R^4$ and $R^5$ each independently represent an alkyl group having 3 to 20 carbon atoms, preferably an alkyl group having 4 to 10 carbon atoms, and more preferably a branched alkyl group having 4 to 10 carbon atoms. $R^4$ and $R^5$ each particularly preferably are a 2-ethylhexyl group.

In formula (A1), M represents a hydrogen atom or a cation. Preferred examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferred; and a lithium ion, a sodium ion and a potassium ion are particularly preferred.

Formula (A2)

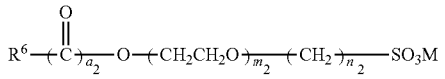

In formula (A2), $R^6$ represents an alkyl group or an alkenyl group, each having 6 to 20 carbon atoms; preferably an alkyl group or an alkenyl group, each having 10 to 20 carbon atoms;

and most preferably an alkyl group or an alkenyl group, each having 14 to 20 carbon atoms.

$R^6$ may represent a branched, alkyl or alkenyl group.

In formula (A2), M represents a hydrogen atom or a cation. Preferred examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferred; and a lithium ion, a sodium ion and a potassium ion are particularly preferred.

$m_2$ represents the average number of added moles, and is preferably larger than 0 and equal to or less than 10. $m_2$ is more preferably 1 to 6, and most preferably 2 to 4.

$n_2$ represents an integer from 0 to 4, and is particularly preferably 2 to 4.

$a_2$ represents 0 or 1, and is particularly preferably 0.

Specific examples of the compound are described below. However, the anionic surfactant of the present invention should not be construed as being limited to the below-described specific examples.

A1-1

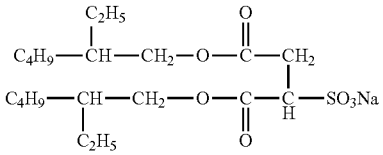

A1-2

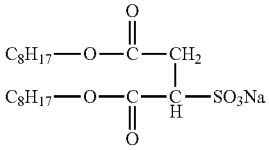

A1-3

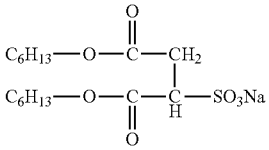

A1-4

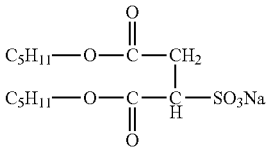

A1-5

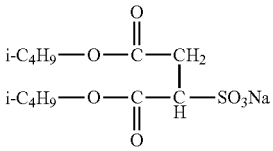

A1-6

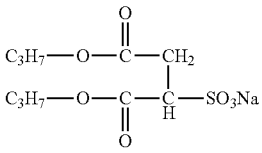

-continued

A1-7

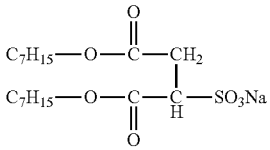

A1-8

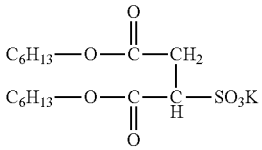

A1-9

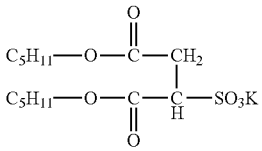

A1-10

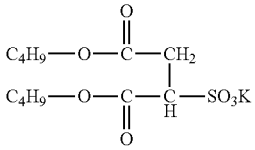

A2-1

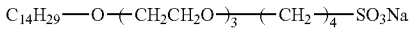

A2-2

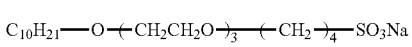

A2-3

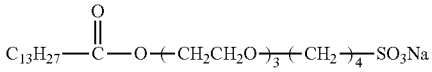

A2-4

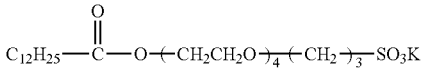

A2-5

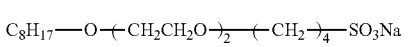

A2-6

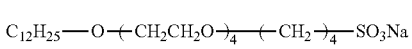

A2-7

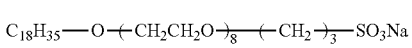

The anionic surfactant represented by formula (A1) and (A2) not only contributes to stabilization of the surface state by imparting wettability to the coating liquid, but also suppresses the generation of separation lines in the high-density image areas by using in combination with the polyether-modified silicone represented by formula (S1). The anionic surfactant also has an effect of preventing gloss unevenness.

The anionic surfactant represented by formulae (A1) and (A2) may be incorporated into any layer such as the heat insulation layer or the intermediate layer, in addition to the receptor layer.

The total coating amount of the anionic surfactant represented by formulae (A1) and (A2) is preferably from 5 $mg/m^2$ to 500 $mg/m^2$, and more preferably from 10 $mg/m^2$ to 200 $mg/m^2$.

Furthermore, in the present invention, other various surfactants such as anionic, nonionic and cationic surfactants may also be used in combination in the receptor layer.

A preferred example of the other surfactants that may be used in combination with the anionic surfactant represented by formulae (A1) and (A2) is a fluorine-containing compound represented by the following formula (H).

Formula (H)

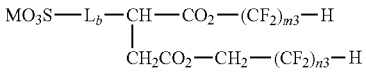

In formula (H), $m_3$ and $n_3$ each independently represents an integer of 2 to 8, preferably 2 to 6, further preferably 3 to 6. The total value of $m_3$ and $n_3$ is preferably 6 or more to 12 or less, more preferably 6 or more to 10 or less. Among them, m3 and n3 are preferably the same, and most preferably m3 and n3 is 4.

Preferred examples of the cation represented by M include an alkali metal ion (e.g., a lithium ion, a sodium ion, a potassium ion), an alkaline-earth metal ion (e.g., a barium ion, a calcium ion), and an ammonium ion. Among these, a lithium ion, a sodium ion, a potassium ion and an ammonium ion are more preferred; and a lithium ion, a sodium ion and a potassium ion are particularly preferred.

$L_b$ represents an alkylene group, which is a single bond. In a case where $L_b$ represents an alkylene group, the alkylene group is preferably an alkylene group having 2 or less carbon atoms, more preferably a methylene group. It is the most preferable that $L_b$ is a single bond.

It is preferable to combine the above preferable embodiments each other in formula (H).

The specific examples of a compound represented by formula (H) are described below. However, the compound represented by formula (H) that can be used in the present invention is not limited thereto. In the following descriptions on the structure of the example compounds, unless particularly stated otherwise, the alkyl group and perfluoroalkyl group mean groups having a linear structure.

(H)-1

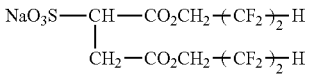

(H)-2

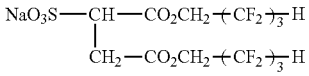

(H)-3

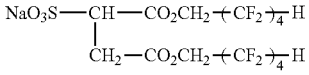

(H)-4

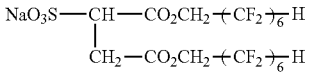

(H)-5

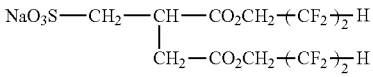

(H)-6

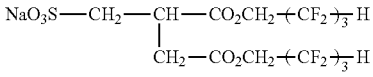

(H)-7

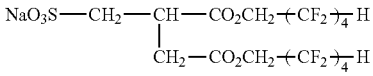

(H)-8

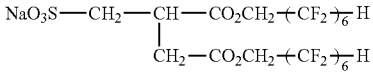

-continued (H)-9

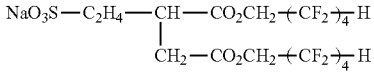

(H)-10

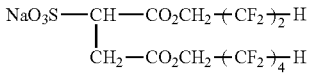

(H)-11

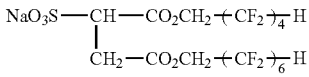

The coating amount of the fluorine-containing compound represented by formula (H) is preferably from 0.5 mg/m$^2$ to 50 mg/m$^2$, and more preferably from 1 mg/m$^2$ to 20 mg/m$^2$ in the layer added with the compound.

(Other Additives)

The receptor layer in the present invention may contain additives, if necessary.

Examples of these additives include an ultraviolet absorbent, an antiseptic agent, a film-forming aid, a film-hardening agent, a matting agent (including a lubricating agent), an oxidation inhibitor, and other additives.

(Ultraviolet Absorbent)

The heat-sensitive transfer image-receiving sheet of the present invention may contain any ultraviolet absorbents. As the ultraviolet absorbents, use can be made of typical inorganic or organic ultraviolet absorbents. As the organic ultraviolet absorbents, use can be made of non-reactive ultraviolet absorbents such as salicylate-series, benzophenone-series, benzotriazole-series, triazine-series, substituted acrylonitrile-series, and hindered amine-series ultraviolet absorbents; copolymers or graft polymers of thermoplastic resins (e.g., acrylic resins) obtained by introducing an addition-polymerizable double bond (e.g., a vinyl group, an acryloyl group, a methacryloyl group), or an alcoholic hydroxyl group, an amino group, a carboxyl group, an epoxy group, or an isocyanate group, to the non-reactive ultraviolet absorbents, subsequently copolymerizing or grafting. In addition, disclosed is a method of obtaining ultraviolet-shielding resins by the steps of dissolving ultraviolet absorbents in a monomer or oligomer of the resin to be used, and then polymerizing the monomer or oligomer (JP-A-2006-21333). In this case, the ultraviolet absorbents may be non-reactive.

Of these ultraviolet absorbents, preferred are benzophenone-series, benzotriazole-series, and triazine-series ultraviolet absorbents. It is preferred that these ultraviolet absorbents are used in combination so as to cover an effective ultraviolet absorption wavelength region according to characteristic properties of the dye that is used for image formation. Besides, in the case of non-reactive ultraviolet absorbents, it is preferred to use a mixture of two or more kinds of ultraviolet absorbents each having a different structure from each other so as to prevent the ultraviolet absorbents from precipitation.

Examples of commercially available ultraviolet absorbents include TINUVIN-P (trade name, manufactured by Ciba-Geigy), JF-77 (trade name, manufactured by JOHOKU CHEMICAL CO., LTD.), SEESORB 701 (trade name, manufactured by SHIRAISHI CALCIUM KAISHA, LTD.), SUMISORB 200 (trade name, manufactured by Sumitomo Chemical Co., Ltd.), VIOSORB 520 (trade name, manufactured by KYODO CHEMICAL CO., LTD.), and ADKSTAB LA-32 (trade name, manufactured by ADEKA).

(Antiseptic)

To the heat-sensitive transfer image-receiving sheet of the present invention, antiseptics may be added. The antiseptics that may be used in the heat-sensitive transfer image-receiving sheet of the present invention are not particularly limited. For example, use can be made of materials described in Bofubokabi (Preservation and Antifungi) HAND BOOK, Gihodo shuppan (1986), Bokin Bokabi no Kagaku (Chemistry of Anti-bacteria and Anti-fungi) authored by Hiroshi Horiguchi, Sankyo Shuppan (1986), Bokin Bokabizai Jiten (Encyclopedia of Antibacterial and Antifungal Agent) edited by The Society for Antibacterial and Antifungal Agent, Japan (1986). Examples thereof include imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, guanidine derivatives, diazine, triazole derivatives, oxazole, oxazine derivatives, and 2-mercaptopyridine-N-oxide or its salt. Of these antiseptics, 4-isothiazoline-3-on derivatives and benzoisothiazoline-3-on are preferred.

(Film-Forming Aid)

To the heat-sensitive transfer image-receiving sheet of the present invention, a high boiling-point solvent is preferably added. The high boiling-point solvent functions as a film-forming aid or a plasticizer and is an organic compound (usually an organic solvent) that reduces the lowest film-forming temperature of a latex polymer. It is described in, for example, Souichi Muroi, "Gosei Latex no Kagaku (Chemistry of Synthetic Latex)", issued by Kobunshi Kanko Kai (1970). Preferable examples of the high boiling-point solvent (film-forming aid) are listed below.

Z-1: Benzyl alcohols

Z-2: 2,2,4-Trimethylpentanediol-1,3-monoisobutyrates

Z-3: 2-Dimethylaminoethanols

Z-4: Diethylene glycols

When these high boiling point solvents are added to the image-receiving sheet, spread of image is observed, and it is not preferable for practical use. However, if the content of the solvents in the coating film is not too large, there is no problem in terms of performance.

(Hardening Agent)

The heat-sensitive transfer image-receiving sheet of the present invention may contain a hardening agent (hardener). The hardening agent may be added to a coated layer(s) of the heat-sensitive transfer image-receiving sheet.

Preferable examples of the hardener that can be used in the present invention include H-1,4,6,8, and 14 in JP-A-1-214845 in page 17; compounds (H-1 to H-54) represented by one of formulae (VII) to (XII) in U.S. Pat. No. 4,618,573, columns 13 to 23; compounds (H-1 to H-76) represented by formula (6) in JP-A-2-214852, page 8, the lower right (particularly, H-14); and compounds described in Claim 1 in U.S. Pat. No. 3,325,287. Examples of the hardening agent include hardening agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis(vinylsulfonylacetamido) ethane, etc.), an N-methylol-series hardening agent (dimethylol urea, etc.), a boric acid, a metaboric acid, or a polymer hardening agent (compounds described, for example, in JP-A-62-234157), can be exemplified. Preferable examples of the hardener include a vinyl sulfone-series hardener and chlorotriazines.

(Matting Agent)

To the heat-sensitive transfer image-receiving sheet of the present invention, a matting agent may be added in order to prevent blocking, or to give a release property or a sliding property. The matting agent may be added on the same side as the coating side of the receptor layer of the image-receiving layer. In detail, the matting agent may be added to the receptor layer, a white layer, a heat transferable protective layer.

Examples of the matting agent generally include fine particles of water-insoluble organic compounds and fine particles of water-insoluble inorganic compounds. In the present invention, the organic compound-containing fine particles are preferably used from the viewpoints of dispersion properties. In so far as the organic compound is incorporated in the particles, there may be organic compound particles consisting of the organic compound alone, or alternatively organic/inorganic composite particles containing not only the organic compound but also the inorganic compound. As the matting agent, there can be used organic matting agents described in, for example, U.S. Pat. Nos. 1,939,213, 2,701,245, 2,322,037, 3,262,782, 3,539,344, and 3,767,448.

[Method for Producing Receptor Layer]

Hereinafter, the method for producing the receptor layer of the present invention will be explained.

The receptor layer of the present invention is preferably a water-based coating. The "aqueous type" here means that 60% by mass or more of the solvent (dispersion medium) of the coating liquid is water. As a component other than water in the coating liquid, a water miscible organic solvent may be used. Examples thereof include methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

In the case of coating two or more receptor layers and other functional layers on the subbing layer of the transparent support, it is known to produce the layers by sequentially coating the various layers over and over, or by coating the various layers in advance on the support and adhering the assemblies, as disclosed in the publications of JP-A-2004-106283, JP-A-2004-181888, JP-A-2004-345267, and the like. It has been known in photographic industries, on the other hand, that productivity can be greatly improved, for example, by providing plural layers through simultaneous multi-layer coating. For example, there are known methods, such as the so-called slide coating (slide coating method) and curtain coating (curtain coating method), as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050 ("JP-B" means examined Japanese patent application); and Edgar B. Gutoff, et al., "Coating and Drying Defects: Troubleshooting Operating Problems", John Wiley & Sons, 1995, pp. 101-103. According to these coating methods, two or more kinds of coating liquids are fed simultaneously into a coater and formed into two or more different layers.

The method for producing the receptor layer used the present invention is preferably carried out by slide coating or curtain coating. Even in the case of coating plural layers, coating of these layers can be carried out by the simultaneous multilayer-coating, and high productivity can be realized.

Here, in the case of performing the simultaneous multi-layer-coating, it is necessary to adjust the viscosity and surface tension of the coating liquid, from the viewpoint of forming a uniform coating film and obtaining satisfactory coatability. The viscosity of coating liquid can be easily adjusted using usual thickeners or viscosity reducers in such a degree that they do not affect to other performances. Beside, the surface tension of coating liquid can be adjusted using various kinds of surfactants.

The temperature of these coating liquids for coating various layers is preferably 25° C. to 60° C., and more preferably 30° C. to 50° C. Particularly, the temperature of the coating liquids in the case of using gelatin in the coating liquid is preferably 33° C. to 45° C.

In the present invention, the coating amount of the coating liquid for a layer is preferably in the range of 1 g/m$^2$ to 500 g/m$^2$. The number of layers in the multilayer constitution can be arbitrarily selected to be two or more. It is preferable that the receptor layer is provided as a layer disposed farthest from the support.

In a drying zone, drying proceeds through: a constant rate period of drying, in which a drying rate is constant, and a material temperature is approximately equal to a wet-bulb temperature; and a falling rate period of drying, in which the drying rate are slowed, and the material temperature rises. In the constant rate drying period, any heat supplied from an external source is all used in the evaporation of moisture. In the falling rate drying period, moisture diffusion inside the material becomes rate-limiting, and the drying rate is lowered due to recession of the evaporation surface or the like. The supplied heat is used in the rising of the material temperature.

In a setting zone and the drying zone, moisture migration occurs between the respective coated films (coated layers) and between the support and the coated films, and a solidification also occurs due to cooling of the coated films and moisture evaporation. For those reasons, the quality and performance of the resultant product is greatly influenced by the processing history, such as the layer surface temperature during drying and the drying period of time, and it is required to set the conditions in accordance with the demanded quality.

The temperature of the setting zone is generally 15° C. or below, and it is preferable to set the cooling step time period in the range from not less than 5 seconds to less than 30 seconds. If the cooling time period is too short, a sufficient increase of the coating liquid viscosity cannot be obtained, and the surface state is deteriorated upon the subsequent drying step. On the other hand, if the cooling time period is too long, the removal of moisture in the subsequent drying step takes time, and the production efficiency is decreased.

After the cooling step generally at 15° C. or below, drying is carried out under an environment generally at above 15° C. In that case, in the present invention, it is preferable to adjust the amount of evaporation of water in the coated films that have been coated in multiple layers within 30 seconds after the completion of cooling, to 60% or more of the amount of moisture contained at the film surface smeared per an area of 1 m$^2$ immediately after coating. The terms "amount of moisture contained at the film surface smeared per an area of 1 m$^2$ immediately after coating", is equal to the water content in the coating liquid prepared before the coating. When the amount of evaporating moisture is not so small, moisture is present on the coated surface not in excess, and the surface state is satisfactory. On the other hand, in the case of adjusting the amount of evaporation to 60% or more, when the drying temperature is brought to a temperature not so higher than 50° C., the evaporation of moisture does not occur rapidly, without causing cracking or the like, and the surface state is satisfactory. Thus, it is preferable to control the drying temperature to 50° C. or below.

Determination of the amount of evaporation can be carried out such that the mass obtained by drying the heat-sensitive transfer image-receiving sheet after coating under the conditions (in an atmosphere) of 110° C. for one hour, is defined as the mass after 100% evaporation, and the difference between the masses before and after drying are measured.

Furthermore, from the viewpoint of enhancing the scratch resistance of the receptor layer, it is preferable to form the receptor layer by carrying out the final drying process under an environment at a temperature of 120° C.

The coating-finished product which has been dried is adjusted to have a certain water content, followed by winding up. Since the progress of film hardening is affected by the water content and temperature during the storage of the wound, coating-finished product, it is necessary to set the conditions for humidification step that are appropriate for the water content in a wound-up state.

In general, the film-hardening reaction can be carried out more easily at higher temperature and higher humidity conditions. However, if the water content is too high, adhesion between the coated products may occur, or there may be a problem in terms of performance. For this reason, it is necessary to set the water content (humidification conditions) in the wound-up state and the storage conditions in accordance with the product quality.

Typical drying devices include an air-loop system and a helical system. The air-loop system is a system in which drying blasts are made to blow on the coating-finished product supported by rollers, and wherein a duct may be mounted either longitudinally or transversely. Such a system has a high degree of freedom in setting of the volume of drying wind, because a drying function and a transporting function are basically separated therein. However, many rollers are used therein, so base-transporting failures, such as gathering, wrinkling and slipping, tend to occur. The helical system is a system in which the coating-finished product is wound round a cylindrical duct in a helical fashion, and transported and dried as it is floated by drying wind (air floating). So no support by rollers is basically required (JP-B-43-20438). In addition to those, there is available a drying system which conveys by reciprocally installing upper and lower ducts and conveying the coating-finished product. In general, this system has a better dryness distribution than that of the helical system, but is poor in floatability.

<Heat-Sensitive Transfer Sheet>

In the heat-sensitive transfer image-receiving sheet of the present invention, the dye is transferred by the heat-sensitive transfer sheet to form an image, and then a white layer (white transfer layer) is transferred. The heat-sensitive transfer sheet for transferring the dye and the heat-sensitive transfer sheet for transferring the white layer may be an integrated sheet or may be separate sheets. It is also acceptable to transfer a heat transferable protective layer after the white layer has been transferred.

The integrated heat-sensitive transfer sheet is a sheet obtained by providing (forming), in area order, on a support such as polyethylene terephthalate (PET), dye layers (colorant layers) prepared by dispersing dyes of three colors, such as yellow, magenta and cyan, respectively in a binder resin, and a white layer. In the case of the separate sheets, for the sheet for dye transfer, use is made of a sheet obtained by providing, in area order, on the support such as described above, dye layers prepared by dispersing dyes of three colors, such as yellow, magenta and cyan, respectively in a binder resin, while for the sheet for white layer transfer, a sheet obtained by providing a white layer on the support such as described above is used.

The term "forming layers in area order" as used in the present specification means forming dye layers each having a different hue and/or function layers in the longitudinal direction on the support of the heat-sensitive transfer sheet, by applying them separately in order.

Examples include the case in which a yellow dye layer, a magenta dye layer, and a cyan dye layer are formed in this order in the longitudinal direction on the support.

Further, any arrangement of these dye layers can be employed, but it is preferred that a yellow dye layer, a magenta dye layer, and a cyan dye layer be arranged sequentially in this order on the support.

Here, upon the dye transfer, an embodiment in which the dye layers are constituted of four colors, including black in addition to the three colors, is also acceptable.

In the case of transferring a protective layer, in the integrated heat-sensitive transfer sheet, a heat-transferable protective layer may be provided after providing the white layer. In the case of the separate sheets, the heat-transferable protective layer may be provided in area order on a heat-sensitive transfer sheet provided with the white layer, or a sheet having the heat-transferable protective layer provided on another sheet may be used.

Furthermore, in the integrated heat-sensitive transfer sheet, the heat-transferable protective layer may be provided before providing the white layer. In the case of separate sheets, a heat-sensitive transfer sheet obtained by providing the respective dye layers of three colors, such as yellow, magenta and cyan, and the heat-transferable protective layer in area order, and the heat-sensitive transfer sheet provided with the white layer may be combined. In this case, the protective layer is formed on the receptor layer, and the white layer is transferred onto this protective layer.

Here, it is preferable for all of the heat-sensitive transfer sheets to have a heat resistant lubricating layer on the side of the support opposite to the side where the dye layer, white layer or heat-transferable protective layer is provided.

[Support]

Conventionally known supports can be used as the support. For example, a polyamide film, a polyimide film, and a polyester film may be mentioned. Among these, a polyester film is preferred, and examples of the polyester film include polyethylene terephthalate (PET) and polyethylene naphthalate (PEN), and polyethylene terephthalate is preferred.

A thickness of the support can be properly determined in accordance with the material of the support so that the mechanical strength and the heat resistance become optimum. Specifically, it is preferred to use a support having a thickness of about 1 μm to about 100 μm, more preferably from about 2 μm to 50 μm, and further preferably from about 3 μm to about 10 μm.

[Dye Layer (Colorant Layer)]

(Binder Resin)

Examples of a binder resin used in the dye layer include acrylic resins such as polyacrylonitrile, polyacrylate, and polyacrylamide; polyvinyl acetal-series resins such as polyvinyl acetoacetal, and polyvinyl butyral; cellulose-series resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate, other modified cellulose resins, nitrocellulose, and ethylhydroxyethylcellulose; other resins such as polyurethane resin, polyamide resin, polyester resin, polycarbonate resin, phenoxy resin, phenol resin, and epoxy resin; and various elastomers. These may be used alone, or two or more thereof may be used in the form of a mixture or copolymer.

(Dye)

The dye is not limited, as long as it is able to diffuse by heat and able to be incorporated in a heat-sensitive transfer sheet, and able to transfer by heat from the heat-sensitive transfer sheet to a heat-sensitive transfer image-receiving sheet. As the dye used for the heat-sensitive transfer sheet, ordinarily used dyes or known dyes can be used.

Preferable examples of the dye include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dye include Disperse Yellow 231, Disperse Yellow 201 and Solvent Yellow 93. Specific examples of the magenta dye include Disperse Violet 26, Disperse Red 60, and Solvent Red 19. Specific examples of the cyan dye include Solvent Blue 63, Solvent Blue 36, Disperse Blue 354 and Disperse Blue 35. As a matter of course, it is also possible to use suitable dyes other than these dyes as exemplified above. Further, dyes each having a different hue from each other as described above may be arbitrarily combined together.

In the heat-sensitive transfer sheet, it is possible to dispose a dye barrier layer between the dye layer and the support.

The surface of the support may be subjected to treatment for easy adhesion to improve wettability and an adhesive property of the coating liquid. Examples of the treatment include corona discharge treatment, flame treatment, ozone treatment, ultraviolet treatment, radial ray treatment, surface-roughening treatment, chemical agent treatment, vacuum plasma treatment, atmospheric plasma treatment, primer treatment, grafting treatment, and other known resin surface modifying treatments.

An easy adhesion layer (easily-adhesive layer) may be formed on the support by coating. Examples of the resin used in the easily-adhesive layer include polyester-series resins, polyacrylate-series resins, polyvinyl acetate-series resins, vinyl-series resins such as polyvinyl chloride resin and polyvinyl alcohol resin, polyvinyl acetal-series resins such as polyvinyl acetoacetal and polyvinyl butyral, polyether-series resins, polyurethane-series resins, styrene acrylate-series resins, polyacrylamide-series resins, polyamide-series resins, polystyrene-series resins, polyethylene-series resins, and polypropylene-series resins.

When the film (layer) used for the support is formed by melt extrusion, it is allowable to subject a non-stretched film to coating treatment followed by stretching treatment.

The above-mentioned treatments may be used in combination of two or more thereof.

[White Layer (White Transfer Layer)]

A white layer used in the heat-sensitive transfer sheet is constituted to include a white pigment intended to impart appropriate white concealability and light diffusibility to the printed matter after transfer, and a binder resin. It is preferable to provide a peeling layer between the white layer and the support. Furthermore, an adhesive layer may be provided on the white layer. Here, if the white layer is transferred onto a pseudo-image without being mediated by the adhesive layer, a conventionally known binder resin having adhesiveness may be used, or an adhesive may be incorporated into the white layer. Regarding the white pigment, typical white pigments as well as filler materials can be used. Therefore, the white pigment as used herein includes filler materials.

The white pigment consists of hard solid particles, and examples that can be used include white pigments such as titanium oxide or zinc oxide; inorganic fillers such as silica, alumina, clay, talc, calcium carbonate, barium sulfate; and resin particles (plastic pigments) of an acrylic resin, an epoxy resin, a polyurethane resin, a phenolic resin, a melamine resin, a benzoguanamine resin, a fluororesin or a silicone resin. Titanium oxide includes rutile titanium oxide and anatase titanium oxide, but any of them may be used.

Any conventionally known binder resin can be used, but preferred examples include an acrylic resin, a cellulose-series resin, a polyester-series resin, a vinyl-series resin, a polyurethane-series resin, a polycarbonate-series resin, and partially crosslinked resins thereof.

To the white layer, a fluorescent whitening agent, in addition to the white pigment and the binder resin can be added. Known compounds having a fluorescent whitening effect, such as a stilbenzene-series compound and a pyrazoline-series compound, can be used as the fluorescent whitening agent. Furthermore, a small amount of colorant may also be incorporated into the white layer.

The white layer is such that when a lenticular lens sheet printed matter to which the white layer has been transferred is viewed under a transmitted light coming from a backlight, the white layer needs to have appropriate light diffusibility and light transmissibility. On the other hand, when the lenticular lens sheet printed matter to which the white layer has been transferred is viewed under a reflected light coming from the front direction, the white layer needs to have appropriate light diffusibility and light reflectability. In the case of the latter, the total light transmittance of the white layer after transfer is preferably 60% or less, and particularly in the case of forming pseudo-images which may serve as a continuous image, the total light transmittance is preferably 50% or less.

In order to adjust the total light transmittance of the white layer after transfer to 60% or less and to impart thereby sufficient white concealability, it is preferable to set the ratio of a binder resin (A) and a white pigment (B) that constitute the white layer, in the range of A/B=1/1 to 1/10. It is particularly preferable to set the lower limit of this amount ratio at 1/1.5, and the upper limit at 1/6. The ratio of A/B is appropriately set in the range described above, depending on the material of the support sheet having a lenticular lens or the receptor layer, to which the white layer is transferred. If the ratio A/B is larger than 1/1, the total light transmittance may exceed 60%, and the white concealability may be decreased. Furthermore, if the white pigment is incorporated in a large amount and the ratio A/B is smaller than 1/10, film coatability deteriorates. Thus, abrasion properties may be deteriorated, or adhesiveness may be deteriorated due to the decrease of the resin content.

The thickness of the white layer is adjusted to about 0.5 to 10 μm.

Measurement of the total light transmittance is carried out as stipulated in JIS K 7105. An excellent printed matter can be formed by setting up the thickness of the ratio A/B and the thickness of the white layer such that the total light transmittance of the white layer transfer section of the heat-sensitive transfer sheet is 60% or less, and preferably 50% or less.

[Peeling Layer]

A peeling layer used in the heat-sensitive transfer sheet constitutes a white layer transfer section together with the white layer, and is formed between the support film and the white layer. The peeling layer is provided to prevent fusion between the heat-sensitive transfer sheet and the lenticular lens sheet, and to facilitate the transfer of the white layer to the receptor layer provided on the lenticular lens sheet without causing any transfer unevenness.

As the peeling layer, for example, a releasable peeling layer that separates from the interface between the peeling layer and a base film, or a cohesive peeling layer that causes cohesion failure within the peeling layer and thereby separates from the base film, can be formed.

The releasable peeling layer can be constructed by adding a releasable material to the binder resin according to necessity. Examples of the binder resin that can be used include thermoplastic resins, for example, acrylic resins such as polymethyl methacrylate, polyethyl methacrylate and polybutyl acrylate; vinyl-series resins such as polyvinyl acetate, vinyl chloride-vinyl acetate copolymers, polyvinyl alcohol, and polyvinyl butyral; and cellulose derivatives such as ethyl cellulose, nitrocellulose, and cellulose acetate; or thermosetting resins, for example, unsaturated polyester resins, polyester resins, polyurethane-series resins, aminoalkyd resins, and the like. The releasable peeling layer can be constructed from a composition containing one kind or two or more kinds of these resins.

Other examples of the releasable material that can be used include resins having releasability, such as waxes, silicone waxes, silicone oils, silicone-series resins, melamine resins, and fluororesins; lubricants such as talc, silica microparticles, surfactants and metal soaps; and the like.

The releasable peeling layer can also be constructed from a resin having releasability. In this case, a silicone-series resin, a melamine resin, a fluororesin and the like can be used, and a graft polymer produced by grafting a releasable segment such as a polysiloxane segment or a fluorinated carbon segment into the molecule of a resin such as an acrylic resin, a vinyl-series resin or a polyester resin, may be used as well. The releasable peeling layer can also be constructed from a composition containing one kind or two or more kinds of the resins mentioned above. The releasable peeling layer may further contain, in addition to the materials described above, a conventionally known fluorescent whitening agent having an effect of a fluorescent whitening of image, such as a stilbenzene-series compound or a pyrazoline-series compound.

The cohesive failing peeling layer causes so-called cohesive failure in the middle part of the peeling layer in the thickness direction when the white layer transfer section is transferred onto the receptor layer, and a portion of the peeling layer remains on the base film without being peeled off, and another portion is transferred onto the printed matter. When the cohesive failing peeling layer peels off and migrates onto the lenticular lens sheet, the concavo-convex shape of the cohesively failed surface is formed on the uppermost surface of the printed matter. When the printed matter is viewed under a transmitted light coming from a backlight, the concavo-convex formed on the uppermost surface of the printed matter diffuses and reflects the illuminated light. This supplements the light diffusibility of the white layer, and thus a printed matter with good visual quality, which has both satisfactory light diffusibility and light transmissibility, can be formed.

As the materials for forming the cohesive failing peeling layer, a binder resin and a releasable material that is added as necessary are used. Examples of the binder resin that can be used include one kind or two or more kinds of resins selected from thermoplastic resins, for example, acrylic resins such as polymethyl methacrylate, polyethyl methacrylate and polybutyl acrylate; vinyl-series resins such as polyvinyl acetate, vinyl chloride-vinyl acetate copolymers, polyvinyl alcohol, and polyvinyl butyral; cellulose derivatives such as ethyl cellulose, nitrocellulose, and cellulose acetate; polyester resins, polyurethane resins, and the like. It is preferable that these binder resins include a resin having a Tg or a softening point of 100° C. or higher, so as to prevent fusion with the support sheet at the time of heat transfer. Furthermore, a resin having a Tg or a softening point of below 100° C. can also be used, if combined with an appropriate releasable material.

Examples of the releasable material that can be used include waxes, inorganic microparticles of talc, silica and the like, and organic microparticles. The releasable material is preferably added in an amount of 0.1 to 200% by mass, and more preferably 10 to 100% by mass, relative to the amount of the binder resin.

When the releasable material is not used in the cohesive failing peeling layer, two or more kinds of resins that have low compatibility with each other among the binder resins mentioned above can be used so that the peeling layer can be peeled off at the interface between the binder resins that form the peeling layer.

The white concealability of the printed matter can be enhanced by incorporating a white pigment into the peeling layer. For example, if the white concealability is insufficient, a printed matter having sufficient white concealability can be obtained by incorporating the white pigment into the white layer as well as the peeling layer, and thereby adjusting the total light transmittance at the white layer and the peeling layer to 60% or less.

Furthermore, if it is wished to impart adhesiveness to the white layer, or to enhance adhesiveness of the white layer, an adhesive binder resin can be incorporated into the white layer. However, in this case, the proportion of the white pigment is correspondingly decreased, and white concealability may become insufficient. In order to supplement such white concealability of the white layer, the white pigment can be incorporated into the peeling layer, and thus a printed matter having sufficient white concealability can be obtained.

For the white pigment that incorporated into the peeling layer, titanium oxide, zinc oxide or the like can be used as described above. The content of the white pigment cannot be defined in a simple manner because the content is defined on the basis of the relationship with the white concealability of the white layer. However, when the white pigment is added to the peeling layer, the addition amount is usually 100 to 500% by mass, while the upper limit is preferably about 300% by mass, and the lower limit is about 200% by mass, all relative to the amount of the binder resin that constitutes the peeling layer.

The releasable or cohesive failing peeling layer as discussed above may also be added with an ultraviolet absorbent for enhancing the weather resistance performance, an oxidation inhibitor, a fluorescent whitening agent (stilbenzene-series or pyrazoline-series compound, or the like) and the like, in addition to the materials described above.

The peeling layer can be formed by the same method as that used for the dye layer, and the thickness is preferably 0.1 to 5.0 μm as obtained after coating and drying.

In regard to the white layer and the peeling layer, those layers described in Japanese Patent No. 3789033 are preferably used.

[Adhesive Layer]

An adhesive layer may be provided on the white layer. A preferably applicable adhesive layer is the adhesive layer for the heat-transferable protective layer that will be described below.

[Heat-Transferable Protective Layer]

The heat-transferable protective layer (laminate) is used to enhance durability such as scratch resistance, water resistance, light resistance or weather resistance, by forming a protective layer formed from a transparent resin, on the heat-transferred white layer by means of heat transfer. The white layer transferred onto the heat-sensitive transfer image-receiving sheet may have insufficient image durability such as light resistance, scratch resistance and chemical resistance, and may also have insufficient image durability such as the light resistance, scratch resistance and chemical resistance of the dye in the receptor layer, which is provided beneath the white layer. Thus, it is preferable to provide such a transparent protective layer. As one example of the heat-transferable protective layer, a releasing layer, a protective layer, and an adhesive layer may be formed on the polyethylene terephthalate (PET) support in this order from the support side. The protective layer may be formed by plural layers. In the case where the protective layer also has a function(s) of another layer(s), the releasing layer or/and the adhesive layer can be omitted. It is also possible to use a support on which an easy adhesive layer has already been formed.

As a protective layer-forming resin, preferred are resins that are excellent in scratch resistance, chemical resistance, transparency and hardness. Examples of the resin include polyester resins, polystyrene resins, acrylic resins, polyurethane resins, acrylic urethane resins, silicone-modified resins of the above-described resins, mixtures of these resins, ionizing radiation-curable resins, and ultraviolet-shielding resins. In addition, there can be used various kinds of resins that are known from the past as a protective layer-forming resin. Further, in order to give ultraviolet absorbing capacity, or to improve coat separation properties at the time of transfer, gloss, brightness, or the like, it is also preferred to add ultraviolet absorbing agents, antioxidants, fluorescent brightening agents, organic fillers and/or inorganic fillers in accordance with necessity.

As the acrylic resin, use can be preferably made of polymers derived from at least one monomer selected from acrylate monomers and methacrylate monomers. Other monomers than these acrylate-series monomers, such as styrene and acrylonitrile may be co-polymerized with said acrylic monomers. A preferred monomer is methyl methacrylate. It is preferred that methyl methacrylate is contained in terms of preparation mass ratio of 50 mass % or more in the polymer.

As the polyester resin, a saturated polyester resin can be used. Examples of an acid component of the polyester resin include aromatic dicarboxylic acids such as terephthalic acid, isophthalic acid, orthophthalic acid, 2,6-naphthalene dicarboxylic acid, teterahydrophthalic acid, hexahydrophthalic acid, hexahydroisophthalic acid, and hexahydroterephthalic acid; aliphatic dicarboxylic acids such as succinic acid, adipic acid, azelaic acid, sebacic acid, dodecanedionic acid, and dimmer acid; and alicyclic dicarboxylic acids such as cyclohexane dicarboxylic acid, tricyclodecane dicarboxylic acid, and decalin dicarboxylic acid. Methyl-esterified derivatives of these compounds may be also used. Further, acid anhydrides of these compounds may be also used.

Further, if necessary, the above-mentioned compounds may be also used together with other compounds such as p-(hydroxyethoxy)benzoic acid, hydroxypivalic acid, γ-butyryllactone, ϵ-caprolactone, fumaric acid, maleic acid, maleic acid anhydrate, itaconic acid, and citraconic acid. Further, if necessary, the above-mentioned compounds may be also used together with tri- or more multi-functional polycarboxylic acids such as tri or tetra carboxylic acids (e.g., trimellitic acid, pyromellitic acid), in so far as the proportion of the tri- or more multi-functional polycarboxylic acids is 10 mol % or less of the entire carboxylic acid components. Particularly preferred is the composition that contains at least one acid component which is an aromatic dicarboxylic acid a part of which is substituted with a sulfonic acid or a salt thereof, in one molecular chain. It is preferable to conduct copolymerization with setting the upper limit of a substitution amount of the sulfonic acid (or salt thereof) within a range that ensures solubility to organic solvents, since this would make it possible to use the polyester resin with mixing with other organic-solvent-soluble additives or resins. As a preferable aromatic dicarboxylic acid substituted with the sulfonic acid (or salt thereof), there are exemplified sulfoterephthalic acid, 5-sulfoisophthalic acid, 4-sulfophthalic acid, 4-sulfonaphthalene-2,7-dicarboxylic acid, 5-(4-sulfophenoxy)isophthalic acid, ammonium salts of these acids, and metal salts of these acids wherein examples of the metal include lithium, potassium, magnesium, calcium, copper, and iron. Of these acids, sodium salt of 5-sulfoisophthalic acid is especially preferred.

Examples of a polyol component that is another component of the polyester resin, include ethylene glycol, 1,2-propylene glycol, 1,3-propane diol, 1,4-butane diol, neopentyl glycol, 1,5-pentane diol, 1,6-hexane diol, 3-methyl-1,5-pentane diol, 1,9-nonane diol, 2-ethyl-2-butylpropane diol, hydroxypivalic acid neopentylglycol ester, dimethylolheptane, and 2,2,4-trimethyl-1,3-pentane diol. If necessary, there can be also used diethylene glycol, triethylene glycol, dipropylene glycol, polyethylene glycol, polypropylene glycol, polytetramethylene glycol, ethylene oxide adducts of neopentyl glycol, and propylene oxide adducts of neopentyl glycol.

As aromatic-group-containing glycols, there are paraxylene glycol, metaxylene glycol, orthoxylene glycol, 1,4-phenylene glycol, ethylene oxide adduct of 1,4-phenylene glycol, bisphenol A, and glycols obtained by adding from 1 to several moles of ethylene oxide or propylene oxide to the two phenolic hydroxyl groups of bisphenols, such as ethylene oxide adducts or propylene oxide adducts of bisphenol A. Examples of alicyclic diol components include tricyclodecane diol, tricyclodecane dimethylol, tricyclodecane dimethanol (TCD-M), cyclohexane diol, 1,4-cyclohexane dimethanol, hydrogenated bisphenol A, ethylene oxide adducts or propylene oxide adducts of hydrogenated bisphenol A. As the above-described polyester resin, a preferable glass transition temperature is within the range from 50° C. to 120° C., and a preferable molecular weight is within the range from 2,000 to 40,000. A molecular weight ranging from 4,000 to 20,000 is more preferred, because so-called "foil-off" properties at the time of transfer of the protective layer are improved.

The use of the above-described ionizing radiation-curable resins enables to obtain a protective layer that is excellent in both resistance to plasticizers and scratch resistance in particular. As an example, there are resins that are obtained by cross-linking and curing radical polymerizable polymers or oligomers upon irradiation of ionizing radiation. At this moment, polymerization and cross-link may be performed by adding a photopolymerization initiator in accordance with necessity, followed by irradiation of electron beam or ultraviolet ray. Further, known ionizing radiation-curable resins can be used.

It is also a preferable embodiment that a protective layer contains ultraviolet-absorbing agents and/or ultraviolet-shielding resins in order to give light-fastness to a printed matter.

Although characteristics of the protective layer vary depending on the kind of protective layer-forming resin, the protective layer is formed by the same method as the method of forming the above-described dye layer. A thickness of the protective layer is preferably in the range of from about 0.5 μm to about 10 μm.

In the case where the protective layer is difficult to strip from the support at the time of transfer, it is also a preferable embodiment to form a releasing layer between the support and the protective layer. The releasing layer can be formed by the steps of preparing a coating liquid composed of a material that is excellent in release properties, such as waxes, silicone wax, silicone resin, and fluorine resin; a relatively high melting point resin that does not melt by heat transferred from a thermal head, such as cellulosic resin, acrylic resin, polyurethane resin, polyvinyl acetal resin, acrylic vinyl ether resin, maleic acid anhydride resin, silicone resin, fluorine resin; or the above-described resins containing a heat release agent such as waxes, and then coating the coating liquid according to a known coating method such as gravure coat and gravure reverse coat, followed by drying. Of these resins, preferred are acryl resins obtained by polymerizing acrylic acid or methacrylic acid singly, or copolymerizing acrylic acid or methacrylic acid with other monomers. These acrylic resins are excellent in adhesion to the support, and release properties from the protective layer. Further, these resins may be used alone or in a combination of these resins.

The releasing layer remains at the side of the polyethylene terephthalate (PET) support at the time of printing (transfer).

A thickness of the layer is preferably in the range of from about 0.5 μm to about 5 μm. Various kinds of particles are incorporated in the releasing layer, or alternatively the surface of the releasing layer at the protective layer-coating side is subjected to a matt treatment, thereby to mat the surface of the releasing layer. Resultantly, the surface of the image-receiving sheet after printing can be mat-finished (flatten).

A separation layer may be formed between the heat transferable protective layer and the releasing layer. The separation layer is transferred together with the protective layer. After transfer, the separation layer becomes the outermost layer of the printed heat-sensitive transfer image-receiving sheet on the white layer side. Therefore, the separation layer is composed of a resin that is excellent in transparency, abrasion resistance and chemical resistance. As the resin, there are exemplified acrylic resin, epoxy resin, polyester resin, and styrene resin. Further, additives such as fillers and waxes may be added to the separation layer.

It is preferred to dispose an adhesive layer on the protective layer as the outermost layer of the heat transferable protective layer laminate. Thereby, transfer properties of the protective layer are improved.

In the adhesive layer, there can be used known adhesives, heat-sensitive adhesives, and thermoplastic resins. Specific examples of the adhesives include resins that are excellent in adhesiveness at the time of heating, such as polyester resin, vinyl chloride/vinyl acetate copolymer resin, acrylic resin, acrylic material-ultraviolet absorbing agent copolymer resin, ultraviolet absorbing resin, butyral resin, epoxy resin, polyamide resin, vinyl chloride resin, and polycarbonate resin. Of these resins, preferred are thermoplastic resins having a glass transition temperature (Tg) of from 40° C. to 80° C.

If Tg is too low, adhesiveness between the coated image and the transparent protective layer tends to become insufficient. On the other hand, if Tg is too high, transfer properties of the transparent protective layer tends to become insufficient.

Among these, especially preferred are polyvinylchloride resins, polyvinyl acetate resins, and vinyl chloride/vinyl acetate copolymer resins, each of which has a polymerization degree of from 50 to 300, more preferably from 50 to 250.

As the ultraviolet absorbing resin, there can be used resins obtained by reaction and bonding of a thermoplastic resin or an ionizing radiation curable resin with a reactive ultraviolet absorbing agent. More specifically, use can be made of a resin obtained by allowing a product produced by introducing a reactive group such as an addition polymerizable double bond (for example, a vinyl group, an acryloyl group, a methacryloyl group or the like), an alcoholic hydroxyl group, an amino group, a carboxyl group, an epoxy group or an isocyanate group, into a conventionally known non-reactive organic ultraviolet absorbent of the salicylate-series, phenyl acrylate-series, benzophenone-series, benzotriazole-series, coumarine-series, triazine-series, nickel chelate-series, substituted acrylonitrile-series or hindered amine-series, to react and bind with the thermoplastic resin or the ionizing radiation-curable resin.

The adhesive layer can contain a resin such as described above, and additives such as an organic ultraviolet absorbent such as a benzophenone-series compound, a benzotriazole-series compound, an oxalic acid anilide-series compound, a cyanoacrylate-series compound or a salicylate-series compound, or inorganic microparticles having ultraviolet absorption capability, such as oxides of zinc, titanium, cerium, tin or iron. Further, it is optional to add other additives such as coloring pigments, white pigments, extender pigments, fillers, antistatic agents, antioxidants, and fluorescent whitening agents in accordance with necessity. The adhesion layer is formed by coating and then drying a coating liquid containing the above-described resin for construction of the adhesion layer, and the above-described additives that are optionally added to the adhesion layer, so that a thickness of the adhesion layer preferably becomes a range of from 0.5 μm to about 10 μm at the dry state. The thickness of the adhesive layer is preferably within the range from 0.5 μm to 5 μm, more preferably from 0.5 μm to 3 μm.

[Heat Resistant Lubricating Layer]

In the heat-sensitive transfer sheet, it is preferred to dispose a heat-resistant lubricating layer (back side layer) on the support at the surface (back side) opposite to the dye layer coating side of the support, namely on the same side as the surface with which a thermal head etc. contacts. Further, in the case of a white layer transfer sheet or protective layer transfer sheet, it is also preferred to dispose the heat-resistant lubricating layer on the same side as the surface with which a thermal head etc. contacts.

If the heat-sensitive transfer sheet is heated by a heating device such as a thermal head in the state such that the back side of the support of the heat-sensitive transfer sheet directly contacts with the heating device, heat seal is apt to occur. In addition, owing to a large friction between them, it is difficult to smoothly transfer the heat-sensitive transfer sheet at the time of printing.

The back side layer is disposed so as to enable the heat-sensitive transfer sheet to withstand heat energy from the thermal head. The heat-resistant lubricating layer prevents the heat seal, and enables a smooth travel action. Recently, the necessity of the heat-resistant lubricating layer is becoming greater on account that the heat energy from the thermal head is increasing in association with speeding-up of the printer.

The heat-resistant lubricating layer is formed by coating a composition wherein additives such as a sliding agent, a release agent, a surfactant, inorganic particles, organic particles, and pigments are added to a binder. Further, an intermediate layer may be disposed between the back side layer and the support sheet. As the intermediate layer, there has been known a layer containing inorganic fine particles and a water-soluble resin or a hydrophilic resin capable of emulsification.

As the binder, a known resin having high heat-resistance may be used. Examples thereof include cellulose resins such as ethylcellulose, hydroxycellulose, hydroxypropylcellulose, methylcellulose, cellulose acetate, cellulose acetate butyrate, cellulose acetate propionate, and nitrocellulose; vinyl-series resins such as polyvinyl alcohol, polyvinyl acetate, polyvinyl butyral, polyvinyl acetal, polyvinyl acetoacetal resin, vinyl chloride-vinyl acetal copolymer and polyvinyl pyrrolidone; (meth)acrylic resins such as methyl polymethacrylate, ethyl polyacrylate, polyacrylamide, and acrylonitrile-styrene copolymer; and natural or synthetic resins such as polyamide resin, polyimide resin, polyamideimide resin, polyvinyl toluene resin, coumarone indene resin, polyester-series resin, polyurethane resin, polyether resin, polybutadiene resin, polycarbonate resin, chlorinated polyolefin resin, fluorine-contained resin, epoxy resin, phenol resin, silicone resin, silicone-modified or fluorine-modified urethane. These may be used alone or in a mixture form.

In order to enhance heat resistance of the heat-resistant lubricating layer, there have been known techniques of cross-linking resins by ultraviolet ray or electron beam radiation. Further, the resin may be cross-linked by heating with a cross-linking agent. According to need, a catalyst may be added to the resin. As an exemplary cross-linking agent, polyisocyanate is known. When the polyisocyanate is used, a resin with a hydroxyl group-based functional group is suited to be cross-linked. JP-A-62-259889 discloses a heat-resistant lubricating layer formed of a reaction product of polyvinyl butyral and an isocyanate compound, to which a bulking agent such as an alkali metal salt or alkaline earth metal salt of phosphoric ester and potassium carbonate is added. JP-A-6-99671 discloses that a heat resistant lubricating layer-forming high molecular compound can be obtained by reacting a silicone compound having an amino group and an isocyanate compound having two or more isocyanate groups in one molecule.

In order to sufficiently exhibit the function, the back side layer may be incorporated with additives such as a sliding agent, a plasticizer, a stabilizer, a bulking agent, and a filler for removing materials adhered to the head.

Examples of the sliding agent include fluorides such as calcium fluoride, barium fluoride, and graphite fluoride; sulfides such as molybdenum disulfide, tungsten disulfide, and iron sulfide; oxides such as lead oxide, alumina, and molybdenum oxide; solid sliding agents of inorganic compounds such as graphite, mica, boron nitride, and clays (e.g., talc, acid clay); organic resins such as fluorine resins and silicone resins; silicone oil; metal soaps such as metal salt of stearic acid; various kinds of waxes such as polyethylene wax and paraffin wax; and surfactants such as anionic surfactants, cationic surfactants, amphoteric surfactants, nonionic surfactants, and fluorine surfactants.

It is also possible to use phosphoric ester surfactants such as zinc salt of alkyl phosphoric monoester or alkyl phosphoric diester. However, the acid group of the phosphate causes a disadvantage such that the phosphate decomposes as a heat quantity from a thermal head becomes large, and consequently the pH of the back side layer reduces, corrosive abrasion of the thermal head becomes heavier. As a measure to deal with the disadvantage, there are known, for example, a method of using a neutralized phosphate surfactant, and a method of using a neutralizing agent such as magnesium hydroxide.

Examples of the other additives include higher fatty acid alcohols, organopolysiloxane, organic carboxylic acids and derivatives thereof, and fine particles of inorganic compounds such as talc and silica.

The heat-resistant lubricating layer is formed by adding additives to the binder exemplified above, dissolving or dispersing the resultant into a solvent to prepare a coating liquid, and then applying the coating liquid by a known method such as gravure coating, roll coating, blade coating, or wire bar coating. The film thickness of the heat-resistant lubricating layer is preferably from 0.1 to 10 μm, more preferably from 0.5 to 5 μm.

<Image-Forming Method>

In the image-forming method using the heat-sensitive transfer image-receiving sheet of the present invention, imaging is formed by superposing the heat-sensitive transfer sheet on the heat-sensitive transfer image-receiving sheet of the present invention so that the dye layer (colorant layer) of the heat-sensitive transfer sheet is in contact with the receptor layer of the heat-sensitive transfer image-receiving sheet, and giving thermal energy in accordance with image signals given from the thermal head.

Specifically, an image-forming may be conducted in a similar manner as described in, for example, JP-A-2005-88545.

In regard to stereoscopic images, it is necessary to print the image at a precise position in accordance with the concavo-convex of the lenticular lens. In connection with this technique, the method described in Japanese Patent No. 3609065 or the like can be used.

It is an object of the present invention to provide a heat-sensitive transfer image-receiving sheet which has less transfer failure at the time of printing and is capable of stably printing an image with high three-dimensional sensation.

According to the present invention, there can be provided a heat-sensitive transfer image-receiving sheet that has less transfer failure at the time of printing and is capable of stably printing an image with high three-dimensional sensation.

EXAMPLES

The present invention will be described in more detail based on the following examples. Any materials, reagents, amount and ratio of use and operations, as shown in the examples, may appropriately be modified without departing from the spirit and scope of the present invention. It is therefore understood that the present invention is by no means intended to be limited to the specific examples below. In the following Examples, the terms "part" and "%" are values by mass, unless they are indicated differently in particular.

Example 1

Synthesis of Polyether-Modified Silicone

Synthesis of the polyether-modified silicone represented by formula (S1) used in the present invention can be carried out using the known methods described in Kunio Itoh, "Silicone Handbook" (Nikkan Kogyo Shimbun Co., Ltd., 1990, p. 163) and the like.

Specifically, in a glass flask equipped with a stirring device and a thermometer, 20 parts by mass of a dimethylsiloxane-methyl hydrogen siloxane copolymer represented by the average structural formula (1):

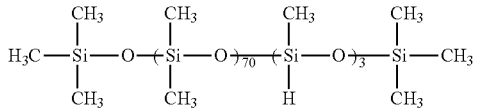

and 40 parts by mass of single-terminal allyl etherified polyoxyalkylene represented by the average structural formula (2): $CH_2{=}CHCH_2O(C_2H_4O)_{20}(C_3H_6O)_{20}CH_3$ were mixed, and 20 parts by mass of isopropyl alcohol was added as a solvent. Furthermore, chloroplatinic acid was added thereto. After the mixture was stirred for 2 hours at 86° C., it was confirmed that the peak representing Si—H in the infrared absorption spectrum disappeared. The mixture was further stirred for 30 minutes. The reaction liquid was concentrated under reduced pressure, and thereby a polyether-modified silicone S1-1 shown in Table 1 below was obtained.

A polyether-modified silicone S1-2 shown in Table 1 below was obtained in the same manner as the polyether-modified silicone S1-1, except that the structure of the single-terminal allyl etherified polyoxyalkylene was changed to the average structural formula (3): $CH_2{=}CHCH_2O(C_2H_4O)_{35}CH_3$.

A polyether-modified silicone S1-3 shown in Table 1 below was obtained in the same manner as the polyether-modified silicone S1-1, except that the structure of the single-terminal allyl etherified polyoxyalkylene was changed to the average structural formula (4): $CH_2{=}CHCH_2O(C_2H_4O)_{10}CH_3$.

A polyether-modified silicone S1-4 shown in Table 1 below was obtained in the same manner as the polyether-modified silicone S1-1, except that the structure of the single-terminal allyl etherified polyoxyalkylene was changed to the average structural formula (5): $CH_2{=}CHCH_2O(C_2H_4O)_{50}(C_3H_6O)_{50}CH_3$.

A polyether-modified silicone S1-5 shown in Table 1 below was obtained in the same manner as the polyether-modified silicone S1-1, except that the structure of the single-terminal allyl etherified polyoxyalkylene was changed to the average structural formula (6): $CH_2{=}CHCH_2O(C_2H_4O)_{40}(C_3H_6O)_{35}CH_3$.

TABLE 1

| Polyether-modified silicone | a1 | b1 |
|---|---|---|
| Polyether-modified silicone S1-1 | 20 | 20 |
| Polyether-modified silicone S1-2 | 35 | 0 |
| Polyether-modified silicone S1-3 | 10 | 0 |
| Polyether-modified silicone S1-4 | 50 | 50 |
| Polyether-modified silicone S1-5 | 40 | 35 |

Receptor Layer Coating Liquid 1

| | |
|---|---|
| Vinyl chloride/acrylic copolymer latex (trade name: Vinybran 900, manufactured by Nissin Chemicals Co., Ltd., solid content: 40%) | 20.0 mass parts |
| Vinyl chloride/acrylic copolymer latex (trade name: Vinybran 690, manufactured by Nissin Chemicals Co., Ltd., solid content: 55%) | 20.0 mass parts |
| Gelatin (10% solution) | 2.0 mass parts |
| Polyvinylpyrrolidone (trade name: K-90, manufactured by ISP Japan Ltd.) | 0.5 mass part |

-continued

| | |
|---|---|
| The above-described polyether-modified silicone S1-4 (100%) | 1.5 mass parts |
| Anionic surfactant A1-1 | 0.5 mass part |
| Water | 50.0 mass parts |

(Production of Sample 101)

A sample 101 was produced by the following procedure.

(1) A polyethylene terephthalate (PET) film (manufactured by Fujifilm Corp.) having the thickness of 188 μm was used as a transparent support, and the PET film (thickness 188 μm) which was running at a rate of 10 m/min was inserted between a mirror-surface roller (ϕ350 mm, surface temperature 15° C.) and a nip roller. A glycol-modified polyethylene terephthalate resin PETG (manufactured by SK Chemicals Corp.) and an adhesive resin (trade name: ADMER, manufactured by Mitsubishi Chemical Corp.) were co-extruded from a T-die (ejection width 350 mm) set up at a temperature of 280° C., at a measured resin temperature of 260 to 280° C., and were supplied between the PET film and the mirror-surface roller. Thus, a sheet having a subbing layer (thickness 220 μm) formed thereon was rolled up by a rolling process.

(2) A receptor layer coating liquid 1 that will be described below was coated on the subbing layer by the method exemplified in FIG. 9 illustrated in U.S. Pat. No. 2,761,791, in an amount of 2.5 g/m$^2$, and thus a receptor layer was provided by coating.

(3) The resin sheet provided with the subbing layer and the receptor layer thereon was wound off at a rate of 10 m/min in a conveyance process, and was inserted between an embossed roller (ϕ350 mm, 40° C.) having a lenticular lens shape (radius 150 μm, lens height 70 μm, pitch 254 μm) and a nip roller. A glycol-modified polyethylene terephthalate resin PETG (manufactured by SK Chemicals Corp.) and the adhesive resin (trade name: ADMER, manufactured by Mitsubishi Chemical Corp.) were co-extruded from the T-die (ejection width 330 mm) set up at a temperature of 280° C., at a measured resin temperature of 260 to 280° C., and were supplied between the resin sheet and the embossed roller to be laminated. Thus, a lenticular sheet (thickness 340 μm) could be obtained.

(Production of Sample 102)

A sample 102 was produced in the same manner as the sample 101, except that the subbing layer was not installed.

(Production of Samples 103 to 107)

Samples 103 to 107 were produced in the same manner as the sample 101, except that the glycol-modified polyethylene terephthalate (PETG) resin used in the subbing layer and the lenticular lens was changed to a polycarbonate (PC) resin, a polyethylene (PE) resin or the like as indicated in Table 2 shown below.

When a polycarbonate resin (trade name: EUPIRON E-200, manufactured by Mitsubishi Engineering Plastics Corp.) was used, the T-die temperature was set up at 320 to 330° C., and the measured resin temperature was adjusted to 290 to 310° C. Furthermore, when a polyethylene resin (trade name: SUMIKASEN L405, manufactured by Sumitomo Chemical Co., Ltd.) was used, the T-die temperature was set up at 290° C., and the measured resin temperature was adjusted to 270 to 290° C.

(Production of Samples 108 to 111)

Samples 108 to 111 were produced in the same manner as the samples 101 and 105, except that VINIBRAN, which was the vinyl chloride/acrylic copolymer latex polymer of the receptor layer coating liquid 1, was changed to VYLONAL MD1100 (trade name, manufactured by Toyobo Co., Ltd.) or VYLONAL MD1480 (trade name, manufactured by Toyobo Co., Ltd.), which were both polyester latexes, as indicated in the Table 2 shown below.

TABLE 2

| Sample No. | Lenticular lens resin | Subbing layer | Latex polymer in receptor layer | Remarks |
|---|---|---|---|---|
| 101 | PETG | PETG | Vinyl chloride/acrylic latex copolymer | This invention |
| 102 | PETG | Not prepared | Vinyl chloride/acrylic latex copolymer | Comparative example |
| 103 | PETG | PE | Vinyl chloride/acrylic latex copolymer | Comparative example |
| 104 | PETG | PC | Vinyl chloride/acrylic latex copolymer | Comparative example |
| 105 | PE | PE | Vinyl chloride/acrylic latex copolymer | This invention |
| 106 | PE | Not prepared | Vinyl chloride/acrylic latex copolymer | Comparative example |
| 107 | PC | PC | Vinyl chloride/acrylic latex copolymer | This invention |
| 108 | PETG | PETG | Polyester (trade name: Vylonal MD1100, manufactured by Toyobo Co., Ltd.) | This invention |
| 109 | PE | PE | Polyester (trade name: Vylonal MD1100, manufactured by Toyobo Co., Ltd.) | This invention |
| 110 | PETG | PETG | Polyester (trade name: Vylonal MD1480, manufactured by Toyobo Co., Ltd.) | This invention |
| 111 | PE | PE | Polyester (trade name: Vylonal MD1480, manufactured by Toyobo Co., Ltd.) | This invention |

(Production of Heat-Sensitive Transfer Sheet)

A polyester film having the thickness of 6.0 μm (trade name: Diafoil K200E-6F, manufactured by MITSUBISHI POLYESTER FILM CORPORATION), that was subjected to an easy-adhesion-treatment on one surface of the film, was used as a support. The following heat resistant lubricating layer coating liquid was applied onto the support on the other surface that was not subjected to the easy-adhesion-treatment, so that the coating amount based on the solid content after drying would be 1 g/m$^2$. After drying, the coating liquid was cured by heat at 60° C.

Coating liquids, which will be detailed later, were used to form, onto the easily-adhesive layer coated surface of the thus-formed polyester film, individual dye layers in yellow, magenta and cyan in area order by coating. In this way, a heat-sensitive transfer sheet was produced. The solid coating amount in each of the dye layers was set to 0.8 g/m$^2$.

Coating Liquid for Heat Resistant Lubricating Layer

| | |
|---|---|
| Acrylic-series polyol resin (trade name: ACRYDIC, A-801 manufactured by Dainippon Ink and Chemicals, Incorporated) | 26.0 mass parts |
| Zinc stearate (trade name: SZ-2000, manufactured by Sakai Chemical Industry Co., Ltd.) | 0.43 mass part |

-continued

| | |
|---|---|
| Phosphate (trade name: PLYSURF A217, manufactured by Dai-ichi Kogyo Seiyaku Co., Ltd.) | 1.27 mass parts |
| Isocyanate (50% solution) (trade name: BURNOCK D-800, manufactured by Dainippon Ink and Chemicals, Incorporated) | 8.0 mass parts |
| Methyl ethyl ketone/toluene (2/1, at mass ratio) | 64 mass parts |

Yellow-Dye-Coating Liquid

| | |
|---|---|
| The following yellow dye | 7.8 mass parts |
| Polyvinylacetal resin (trade name: S-LEC KS-1, manufactured by Sekisui Chemical Co., Ltd.) | 6.1 mass parts |
| Polyvinylbutyral resin (trade name: DENKA BUTYRAL #6000-C, manufactured by DENKI KAGAKU KOGYOU K. K.) | 2.1 mass parts |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene (2/1, at mass ratio) | 84 mass parts |

Magenta-Dye-Coating Liquid

| | |
|---|---|
| The following magenta dye | 7.8 mass parts |
| Polyvinylacetal resin (trade name: S-LEC KS-1, manufactured by Sekisui Chemical Co., Ltd.) | 8.0 mass parts |
| Polyvinylbutyral resin (trade name: DENKA BUTYRAL #6000-C, manufactured by DENKI KAGAKU KOGYOU K. K.) | 0.2 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene (2/1, at mass ratio) | 84 mass parts |

Cyan-Dye-Layer-Coating Liquid

| | |
|---|---|
| The following cyan dye | 7.8 mass parts |
| Polyvinylacetal resin (trade name: S-LEC KS-1, manufactured by Sekisui Chemical Co., Ltd.) | 7.4 mass parts |
| Polyvinylbutyral resin (trade name: DENKA BUTYRAL #6000-C, manufactured by DENKI KAGAKU KOGYOU K. K.) | 0.8 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene (2/1, at mass ratio) | 84 mass parts |

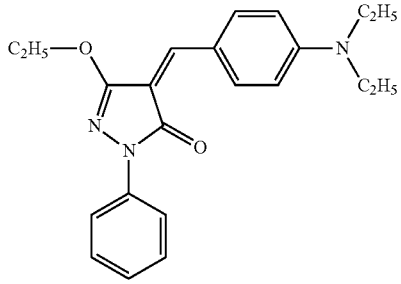

Yellow dye

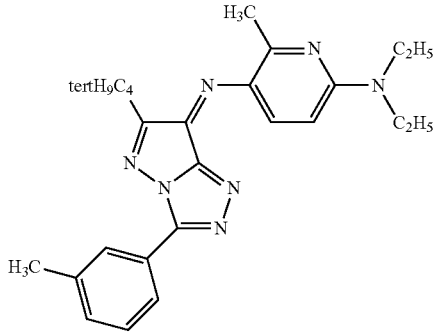

Magenta dye

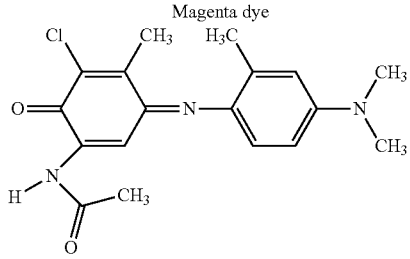

Cyan dye

A transferable white layer laminate was formed by applying a peeling layer coating liquid and a white layer coating liquid having compositions as shown below on the same polyester film as that used in the production of the dye layer, according to the method described in Japanese Patent No. 3789033. The coating amount at the time of film drying was set at 0.6 g/m$^2$ for the peeling layer and 2.0 g/m$^2$ for the white layer.

Coating Liquid for Peeling Layer

| | |
|---|---|
| Acrylic resin (trade name: LP-45M, manufactured by Soken Chemical Co., Ltd.) | 16 mass parts |
| Polyethylene wax (average particle size: about 1.1 .μm) | 8 mass parts |
| Toluene | 76 mass parts |

Coating Liquid for White Layer

| | |
|---|---|
| Modified acrylic resin (trade name: ACRYDICK BZ-1160, manufactured by Dainippon Ink Co., Ltd.) | 20 mass parts |
| Anatase-type titanium oxide (trade name: TCA888, manufactured by Tochem Products Co., Ltd.) | 40 mass parts |
| Fluorescent whitening agent (trade name: UVITEX OB, manufactured by Ciba-Geigy Corp.) | 0.3 mass part |
| Toluene/isopropyl alcohol (1/1, at mass ratio) | 40 mass parts |

(Image Forming Method)

Fujifilm thermal photoprinter ASK-2000 (trade name, manufactured by Fujifilm Corp.) was used as a printer for image formation, and the photoprinter was modified to be capable of being loaded with the heat-sensitive heat transfer sheet and the heat-sensitive transfer image-receiving sheet, by referring to Japanese Patent Nos. 3789033 and 3609065. Thus, printing was performed under the settings that allow the whole gamut of grey scale from the lowest density to the highest density to be obtained.

(Evaluation of DMax)

The visual density of the black image obtained in the above condition was measured by Photographic Densitometer (trade name, manufactured by X-Rite Incorporated).

(Evaluation of Transfer Failure)

For each of the samples, 10 sheets of 2 L-sized black images at the Dmax part were continuously printed, and the number of white or colored transfer failures in a spot form was evaluated by visual observation.

(Evaluation of Passage Failure)

For each of the samples, 1000 sheets of 2 L-sized snapshot photographs were continuously printed, and the number of failures in which the printed paper was caught in the printer machine and the operation was stopped, was evaluated.

The obtained results are shown in Table 3 below.

The heat-sensitive transfer image-receiving sheet of the present invention of the samples 101 and 107 to 111 had fewer transfer failures and a low frequency of appearance of images with low three-dimensional sensation, and exhibited remarkable effects, as compared with the heat-sensitive transfer image-receiving sheets 102 to 104 and 106 of the comparative examples. The sheets of the present invention had fewer passage failures.

The sample 101 which used PETG for the subbing layer and a vinyl chloride/acrylic copolymer as a latex polymer in the receptor layer, showed particularly remarkable effects, and it could be seen that a high Dmax effect is obtained by using a vinyl chloride/acrylic copolymer as a latex polymer in the receptor.

TABLE 3

| Sample No. | Transfer defect (number/2 L, 10 sheets) | Three-dimensional sensation | Dmax | Passage failure (number of time/ 2 L, 1000 sheets) | Remarks |
|---|---|---|---|---|---|
| 101 | 0 | 5 | 2.03 | 0 | This invention |
| 102 | 110 | 1 | 2.00 | 30 | Comparative example |
| 103 | 1 | 2 | 2.03 | 20 | Comparative example |
| 104 | 1 | 2 | 2.03 | 20 | Comparative example |
| 105 | 5 | 4 | 2.03 | 2 | This invention |
| 106 | 120 | 1 | 2.03 | 37 | Comparative example |
| 107 | 5 | 4 | 2.03 | 3 | This invention |
| 108 | 10 | 5 | 1.75 | 2 | This invention |
| 109 | 12 | 4 | 1.71 | 2 | This invention |
| 110 | 11 | 5 | 1.75 | 2 | This invention |
| 111 | 12 | 4 | 1.71 | 2 | This invention |

(Evaluation of Three-Dimensional Sensation)

For each of the samples, 50 sheets of 2 L-sized snapshot photographs were continuously printed, and the three-dimensional sensation of the images was subjected to a sensory evaluation. Regarding the images, photographs of a person taken against a background of a distant view such as mountains, photographs of a family taken in a photo studio, and portrait photographs of a woman wearing a wedding dress were used, and a sensory evaluation was carried out to see whether the person seems floating against the background, or whether the face of the person seems stereoscopic.

Score 5: All of the images have high three-dimensional sensation.

Score 4: There are fewer than 3 sheets of images with low three-dimensional sensation.

Score 3: There are equal to or more than 3 sheets and fewer than 7 sheets of images with low three-dimensional sensation.

Score 2: There are equal to or more than 7 sheets and fewer than 10 sheets of images with low three-dimensional sensation.

Score 1: There are 10 sheets or more of images with low three-dimensional sensation.

The photographs of the person taken against the background of the distant view such as mountains were highly likely to exhibit three-dimensional sensation, but the photographs of the family taken in the photo studio and the portrait photographs of a woman wearing the wedding dress were images that were difficult to exhibit three-dimensional sensation.

Example 2

Samples 201 to 204 were produced in the same manner as the sample 101, except that the polyether-modified silicone S1-4 of the receptor layer coating liquid 1 was changed to equal masses of S1-1, S1-2, S1-3 and S1-5, respectively, and the same evaluation as that performed in the Example 1 was carried out. As a result, although there were some variations in the extent of the effect, all of the samples were recognized to have improving effects on the transfer failure, three-dimensional sensation, Dmax and passage failure. Furthermore, a sample 205 was produced in the same manner as the sample 101, except that the polyether-modified silicone S1-4 was not used, and the same evaluation was carried out. Thus, it was confirmed that using the polyether-modified silicone represented by formula (S1) boosts up these effects.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2009-214798 filed in Japan on Sep. 16, 2009, which is entirely herein incorporated by reference.

What we claim is:

1. A heat-sensitive transfer image-receiving sheet, comprising on a transparent support formed from a polysulfone resin, a polyimide resin, or a biaxially stretched polyethylene terephthalate resin:

a lenticular lens; and at least one receptor layer, wherein the heat-sensitive transfer image-receiving sheet has a subbing layer which contains a resin that is identical with at least one resin constituting the lenticular lens, on the side of the transparent support opposite to the side on which the lenticular lens is provided, and wherein the heat-sensitive transfer image-receiving sheet has a receptor layer containing a latex polymer on the subbing layer.

2. The heat-sensitive transfer image-receiving sheet according to claim 1, wherein said at least one resin that constitutes the lenticular lens and identical to at least one resin that constitutes the subbing layer is a polymethyl methacrylate resin, a polycarbonate resin, a polystyrene resin, a methacrylate-styrene copolymer resin, a polyethylene resin, a polyethylene terephthalate resin, or a glycol-modified polyethylene terephthalate resin.

3. The heat-sensitive transfer image-receiving sheet according to claim 1, wherein at least one of the latex polymers is a copolymer containing a vinyl chloride component as a constituent component.

4. The heat-sensitive transfer image-receiving sheet according to claim 1, wherein the receptor layer contains, together with the latex polymer; at least one polyether-modified silicone represented by formula (S1):

Formula (S1)

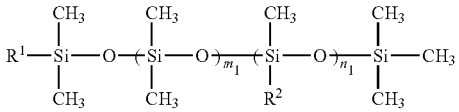

wherein $R^1$ represents an alkyl group; $R^2$ represents $—X—(C_2H_4O)_{a1}—(C_3H_6O)_{b1}—R^3$; $R^3$ represents a hydrogen atom, an acyl group, an alkyl group, a cycloalkyl group or an aryl group; X represents an alkylene group or an alkyleneoxy group; $m_1$ and $n_1$ each independently represents a positive integer; $a_1$ represents a positive integer; and $b_1$ represents 0 or a positive integer.

* * * * *